US006738594B2

(12) United States Patent
Nakagawa et al.

(10) Patent No.: US 6,738,594 B2
(45) Date of Patent: May 18, 2004

(54) COLOR IMAGE FORMING APPARATUS AND CONTROL METHOD THEREOF

(75) Inventors: Takashi Nakagawa, Nara (JP); Kazuyuki Oogita, Soraku-gun (JP); Yasuhiro Takai, Sakurai (JP); Toshiaki Kobayashi, Tenri (JP); Osamu Fujimoto, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/294,743

(22) Filed: Nov. 15, 2002

(65) Prior Publication Data

US 2003/0095815 A1 May 22, 2003

(30) Foreign Application Priority Data

Nov. 16, 2001 (JP) ..... 2001-351859

(51) Int. Cl.[7] ..... G03G 15/01; G03G 15/16

(52) U.S. Cl. ..... 399/299; 399/66; 399/85; 399/82

(58) Field of Search ..... 399/66, 82, 85, 399/167, 297, 298, 299, 300, 302, 303

(56) References Cited

U.S. PATENT DOCUMENTS 6,029,023 A * 2/2000 Munemori et al. ..... 399/66
6,453,139 B2 * 9/2002 Sasame et al. ..... 399/167

* cited by examiner

*Primary Examiner*—Hoang Ngo
(74) *Attorney, Agent, or Firm*—Birch, Stewart, Kolasch & Birch, LLP

(57) ABSTRACT

When a transfer and conveyance belt mechanism has already started moving and a recording sheet has just passed through a cyan color photoreceptor drum, photoreceptor drums for cyan, magenta and yellow colors have not yet abutted on the transfer and conveyance belt. Then, only when the recording sheet has passed through the yellow color photoreceptor drum, the photoreceptor drums for cyan, magenta and yellow abut transfer and conveyance belt at the same time.

37 Claims, 10 Drawing Sheets

COLOR IMAGE FORMING APPARATUS AND CONTROL METHOD THEREOF

This nonprovisional application claims priority under 35 U.S.C. §119(a) on U.S. patent application Ser. No. 2001-351859 filed in Japan on Nov. 16, 2001, which is herein incorporated by reference.

BACKGROUND OF THE INVENTION (1) Field of the Invention

The present invention relates to a tandem type color image forming apparatus and its control method wherein a multiple number of image forming devices for forming different colors of images are placed serially in the direction of conveyance of recording media. The present invention is particularly directed to a tandem type color image forming apparatus and its control method wherein different image forming modes are used for monochrome and multi-color image forming operations.

(2) Description of the Prior Art

Conventionally there have been known tandem type color image forming apparatuses, which are improved in throughput of image forming by serially arranging multiple, e.g., four image stations (image forming units or image forming devices) having image supports forming electrostatic latent images corresponding to multiple colors, e.g., four image colors K: black, C: cyan, M: magenta and Y: yellow, along the direction of conveyance of recording media.

In such a conventional tandem type color image forming apparatus, usually there is use of only one image forming station, with the others unused, when a monochrome image is formed. Therefore, in the monochrome image forming mode, the image supports of the image forming stations other than the one needed are adapted to stop rotating.

Since the image supports are stopped rotating by the above arrangement so that the image supports will not come into contact with the recording media, an intermediate transfer medium, or the like, more than needed, it is possible to avoid deterioration of the image supports due to abrasion and the like. Thus, this control leads to reduction in running cost.

In particular, in color image forming apparatuses, use of B/W (monochrome) image forming is made more frequently compared to use of full and mono color image forming operations. Therefore, the image forming stations other than that for K, or more explicitly, for C, M and Y are, in most cases, kept away from the recording media or the intermediate medium.

In this case, upon a mode change between monochrome image forming and color image forming, image supports to be non-rotated are separated from the transfer belt as a transfer support or image supports to be rotated are set into contact therewith. Therefore, with conventional typical technologies, the image supports are adapted to start rotating after discharge of the recording sheet from the transfer belt. Then, the image supports are shifted or the transfer belt or the transfer and conveyance support for supporting a transfer belt is shifted so that the supports to be rotated come into contact with the transfer belt while the image supports are stopped rotating after the transfer belt or the transfer and conveyance support for supporting a transfer belt is shifted so that the supports to be non-rotated are moved away from the transfer belt.

However, since the operation relating to the-separation and abutment of the image supports and the transfer belt needs a certain period of time, there has been a problem that it takes along time if a set of documents which contains monochrome pages without color images and multicolor pages with color images needs to be image formed.

In order to solve the above problem, a variety of technologies have been proposed.

For example, Japanese Patent Application Laid-open Hei 11 No. 133697 discloses a technology in which a rearrangement control means is provided in order to change the order of pages to be formed with images where the pages containing color and monochrome images are segregated into color page and monochrome page groups and reproduced separately one from the other. In this prior art, since it is possible to reduce the number times the transfer and conveyance support is shifted, it is not only possible to reduce the running cost but also to solve the above problem, or reduce the time for image forming of the whole images.

However, even though the method disclosed in Japanese Patent Application Laid-open Hei 11 No. 133697 is able to reduce the time for image forming, it entails new problems including increase in cost and lowering of user convenience.

More specifically, provision of the rearrangement control means increases the complexity of the control system of the color image forming apparatus hence increase the production cost of the machine and the cost for maintenance. Further, since the recording sheets with images formed using the rearrangement control means are not arranged in the correct order, the user has to rearrange them in the collated order.

In this case, an intermediate tray or the like which can temporarily hold the recording sheets may be provided in the color image forming apparatus so that the recording sheets printed out first and the recording sheets printed out later can be rearranged in the collated order. However, provision of the intermediate tray increases the number of parts of the color image forming apparatus and hence further increases the production cost, which results in an inefficient solution.

SUMMARY OF THE INVENTION

The present invention has been devised in view of the above problems, it is therefore an object of the present invention to provide a color image forming apparatus and its control method, wherein, when documents which include monochrome pages without color images and multicolor pages with color images are handled for image forming, the speed of image forming can be improved without any change of printed page order while degradation of the image supports can be prevented.

In order to achieve the above object, the present invention is configured as follows:

In accordance with the first aspect of the present invention, a color image forming apparatus includes: a plurality of image forming devices placed serially in the direction of conveyance of recording sheets; a transfer support which is arranged in abutment with image supports provided in the image forming devices and is separable therefrom, for transferring images from the image supports to a recording sheet; a mode switching means for making a changeover between the monochrome image forming mode for forming images using only one image forming device of the plural image forming devices and the multi-color image forming mode for forming images using the plural image forming devices; and a control means for governing the image forming devices, the image supports, the transfer support and the mode switching means, the control means making a control so that the transfer support can abut only the image forming devices which are actually engaged in image forming, among the plural image forming devices, and is characterized in that the mode switching means starts the changeover from the monochrome image forming mode to the multi-color image forming mode while the recording sheet remains on the transfer support.

In accordance with the second aspect of the present invention, the color image forming apparatus having the above first feature is characterized in that the mode switching means starts the mode change immediately after the image has been transferred from the image support of the most upstream image forming device to the recording sheet.

In accordance with the third aspect of the present invention, the color image forming apparatus having the above first feature is characterized in that each of the image supports is comprised of a rotational photoreceptor drum and the control means makes a control so that the transfer support abuts the image supports after the image supports start rotating.

In accordance with the fourth aspect of the present invention, the color image forming apparatus having the above second feature is characterized in that each of the image supports is comprised of a rotational photoreceptor drum and the control means makes a control so that the transfer support abuts the image supports after the image supports start rotating.

In accordance with the fifth aspect of the present invention, the color image forming apparatus having the above third feature is characterized in that at least the surface of the transfer support moves in the direction of conveyance of the recording sheet and the control means makes a control so that the image supports and transfer support abut each other after the rotational speeds of the image supports and that of the transfer support coincide.

In accordance with the sixth aspect of the present invention, the color image forming apparatus having the above fourth feature is characterized in that at least the surface of the transfer support moves in the direction of conveyance of the recording sheet and the control means makes a control so that the image supports and transfer support abut each other after the rotational speeds of the image supports and that of the transfer support coincide.

In accordance with the seventh aspect of the present invention, the color image forming apparatus having the above first feature is characterized in that the initial mode when the power supply is turned on and in the ready mode can be set at either the monochrome image forming mode or the multi-color image forming mode.

In accordance with the eighth aspect of the present invention, the color image forming apparatus having the above seventh feature further comprises a control means for setting the initial mode at the activation of the power supply and at the ready mode, into either the monochrome image forming mode or the multi-color image forming mode.

In accordance with the ninth aspect of the present invention, the color image forming apparatus having the above first feature is characterized in that the transfer support is comprised of a transfer and conveyance support for conveying the recording sheet by its rotationally moving surface or an intermediate transfer support to which images are transferred from the image supports.

In accordance with the tenth aspect of the present invention, the color image forming apparatus having the above first feature further comprises a shifting means for shifting the image supports and/or the transfer support.

In accordance with the eleventh aspect of the present invention, the color image forming apparatus having the above first feature is characterized in that, upon a mode change from the monochrome image forming mode to the multi-color image forming mode, the transfer support is caused to abut the plural image forming devices used for the multi-color image forming mode, after when the rear end of the recording sheet having passed through the transfer station of the image forming device used for the monochrome image forming mode, has passed through the most upstream image forming device of those used in the multi-color image forming mode.

In accordance with the twelfth aspect of the present invention, the color image forming apparatus having the above first feature is characterized in that the transfer support conveys the recording sheet at a speed higher than the speed of conveyance of the recording sheet at the image forming device used in the monochrome image forming mode, during the period from when the rear end of the recording sheet has passed through the image forming device used for the monochrome image forming mode until it passes through at least the most upstream image forming device among those used in the multi-color mode.

In accordance with the thirteenth aspect of the present invention, the color image forming apparatus having the above first feature is characterized in that printing at a mode change from the monochrome image forming mode to the multi-color image forming mode starts after at least one of the image forming devices used for the multi-color image forming mode has become abutted with the transfer support.

In accordance with the fourteenth aspect of the present invention, the color image forming apparatus having the above first feature is characterized in that, upon a mode change from the monochrome image forming mode to the multi-color image forming mode, the speed of conveyance of the recording sheet on the transfer support is increased to be greater than the speed of conveyance of the recording sheet passing at the image forming device used in the monochrome image forming mode, and during this period, the image forming devices for the monochrome image forming mode and the multi-color image forming mode, abutting the transfer support, are rotated at a peripheral speed equal to or greater than the speed at which the recording sheet is conveyed by the transfer support.

In accordance with the fifteenth aspect of the present invention, the color image forming apparatus having the above fourteenth feature is characterized in that the peripheral speeds of the image forming devices used in the monochrome image forming mode and in the multi-color image forming mode are set to fall within the range of 1.0 to 1.2 times of the speed at which the recording sheet is conveyed by the transfer support.

In accordance with the sixteenth aspect of the present invention, the color image forming apparatus having the above fourteenth feature is characterized in that the status in which the rotational speed of the image forming devices used in the multi-color image forming mode is greater than the speed of conveyance of the recording sheet on the transfer support is made to end after the rear end of the recording sheet has passed through the most downstream image forming device adjacent to the fixing mechanism to be located next to the transfer support and the rotational speed of the image forming devices is shifted into the speed for the multi-color image forming mode.

In accordance with the seventeenth aspect of the present invention, the color image forming apparatus having the above twelfth feature is characterized in that the speed of conveyance of the recording sheet by the transfer support is increased to be greater than the speed of conveyance of the recording sheet passing at the image forming device used in the monochrome image forming mode, and during this period, a higher voltage than the erasing voltage that is applied at the normal speed is applied to a transfer support erasing element arranged with the transfer support.

In accordance with the eighteenth aspect of the present invention, the color image forming apparatus having the above fourteenth feature is characterized in that a higher voltage than the erasing voltage that is applied at the normal speed is applied to the erasing elements of the image forming devices used in the monochrome image forming mode and the multi-color image forming mode, during the period in which the rotational speed of the image forming devices used in the monochrome image forming mode and the multi-color image forming mode is set to be equal to or greater than the speed of conveyance of the recording sheet on the transfer support.

In accordance with the nineteenth aspect of the present invention, the color image forming apparatus having the above first feature is characterized in that the rotational speed of the plural image forming devices is kept to be equal to or greater than the speed of conveyance of the recording sheet on the transfer support until the leading end of the recording sheet is conveyed to the fixing mechanism which is located downstream of the transfer support.

In accordance with the twentieth aspect of the present invention, the color image forming apparatus having the above nineteenth feature is characterized in that, upon a mode change from the monochrome image forming mode to the multi-color image forming mode, the speed at which the recording sheet is conveyed through the fixing mechanism is kept constant from the leading end of the recording sheet reaches the fixing mechanism until the rear end of the recording sheet passes through the fixing mechanism.

In accordance with the twenty-first aspect of the present invention, a control method of a color image forming apparatus which comprises: a plurality of image forming devices placed serially in the direction of conveyance of recording sheets; and a transfer support arranged in abutment with each image support provided in each image forming device, in a separable manner therefrom, and is controlled so that the transfer support is separated from the image supports when a plurality of image forming devices are not used for image forming, wherein the operating mode can be changed over between the monochrome image forming mode for forming images using only one image forming device of the plural image forming devices and the multi-color image forming mode for forming images using the plurality of image forming devices, is characterized in that the mode change from the monochrome image forming mode to the multi-color image forming mode is started while the recording sheet remains on the transfer support.

In accordance with the twenty-second aspect of the present invention, the control method of a color image forming apparatus, having the above twenty-first feature is characterized in that the action of the image forming mode change is started immediately after the image formed on the image support of the most upstream image forming device has transferred to the recording sheet.

In accordance with the twenty-third aspect of the present invention, the control method of a color image forming apparatus, having the above twenty-first feature is characterized in that the image supports and the transfer support are both configured to be rotatable and the transfer support is caused to abut the image supports after the image supports have started rotating.

In accordance with the twenty-fourth aspect of the present invention, the control method of a color image forming apparatus, having the above twenty-second feature is characterized in that the image supports and the transfer support are both configured to be rotatable and the transfer support is caused to abut the image supports after the image supports have started rotating.

In accordance with the twenty-fifth aspect of the present invention, the control method of a color image forming apparatus, having the above twenty-third feature is characterized in that the image supports and the transfer support are made to abut each other after the rotational speeds of the image supports and that of the transfer support at the abutment portions coincide.

In accordance with the twenty-sixth aspect of the present invention, the control method of a color image forming apparatus, having the above twenty-fourth feature is characterized in that the image supports and the transfer support are made to abut each other after the rotational speeds of the image supports and that of the transfer support at the abutment portions coincide.

In accordance with the twenty-seventh aspect of the present invention, the control method of a color image forming apparatus, having the above twenty-first feature is characterized in that the initial mode when the power supply is turned on and in the ready mode can be set at either the monochrome image forming mode or the multi-color image forming mode.

In accordance with the twenty-eighth aspect of the present invention, the control method of a color image forming apparatus, having the above twenty-second feature is characterized in that the initial mode when the power supply is turned on and in the ready mode can be set at either the monochrome image forming mode or the multi-color image forming mode.

In accordance with the twenty-nine aspect of the present invention, the control method of a color image forming apparatus, having the above twenty-third feature is characterized in that the initial mode when the power supply is turned on and in the ready mode can be set at either the monochrome image forming mode or the multi-color image forming mode.

In accordance with the thirtieth aspect of the present invention, the control method of a color image forming apparatus, having the above twenty-fourth feature is characterized in that the initial mode when the power supply is turned on and in the ready mode can be set at either the monochrome image forming mode or the multi-color image forming mode.

In accordance with the thirty-first aspect of the present invention, the control method of a color image forming apparatus, having the above twenty-fifth feature is characterized in that the initial mode when the power supply is turned on and in the ready mode can be set at either the monochrome image forming mode or the multi-color image forming mode.

In accordance with the thirty-second aspect of the present invention, the control method of a color image forming apparatus, having the above twenty-sixth feature is characterized in that the initial mode when the power supply is turned on and in the ready mode can be set at either the monochrome image forming mode or the multi-color image forming mode.

In accordance with the thirty-third aspect of the present invention, the control method of a color image forming apparatus, having the above twenty-seventh feature is characterized in that the initial mode is set to be either the monochrome image forming mode or the multi-color image forming mode by the predetermined operation through a control means.

In accordance with the thirty-fourth aspect of the present invention, the control method of a color image forming apparatus, having the above twenty-eighth feature is characterized in that the initial mode is set to be either the monochrome image forming mode or the multi-color image forming mode by the predetermined operation through a control means.

In accordance with the thirty-fifth aspect of the present invention, the control method of a color image forming apparatus, having the above twenty-ninth feature is characterized in that the initial mode is set to be either the monochrome image forming mode or the multi-color image forming mode by the predetermined operation through a control means.

In accordance with the thirty-sixth aspect of the present invention, the control method of a color image forming apparatus, having the above thirtieth feature is characterized in that the initial mode is set to be either the monochrome image forming mode or the multi-color image forming mode by the predetermined operation through a control means.

In accordance with the thirty-seventh aspect of the present invention, the control method of a color image forming apparatus, having the above thirty-first feature is characterized in that the initial mode is set to be either the monochrome image forming mode or the multi-color image forming mode by the predetermined operation through a control means.

In accordance with the thirty-eighth aspect of the present invention, the control method of a color image forming apparatus, having the above thirty-second feature is characterized in that the initial mode is set to be either the monochrome image forming mode or the multi-color image forming mode by the predetermined operation through a control means.

DESCRIPTION OF THE PREFERRED EMBODIMENTS

The embodiments of a color image forming apparatus and its control method will hereinafter be described with reference to the accompanying drawings.

<The First Embodiment>

The first embodiment of a color image forming apparatus according to the present invention will be described with reference to FIGS. 1 to 7.

The color image forming apparatus according to the first embodiment of the present invention has a tandem type configuration in which a multiple number of image forming units are arranged one behind another along the direction of conveyance of recording media such as recording paper or the like. This color image forming apparatus has two changeable modes, i.e., the monochrome image forming mode for image forming with one image forming unit only and the multi-color image forming mode for image forming with multiple image forming units and is configured so that the mode change from the monochrome image forming mode to the multi-color image forming mode starts while the preceding recording sheet remains on the transfer support.

<Configuration of the Color Image Forming Apparatus>

Figure 1:
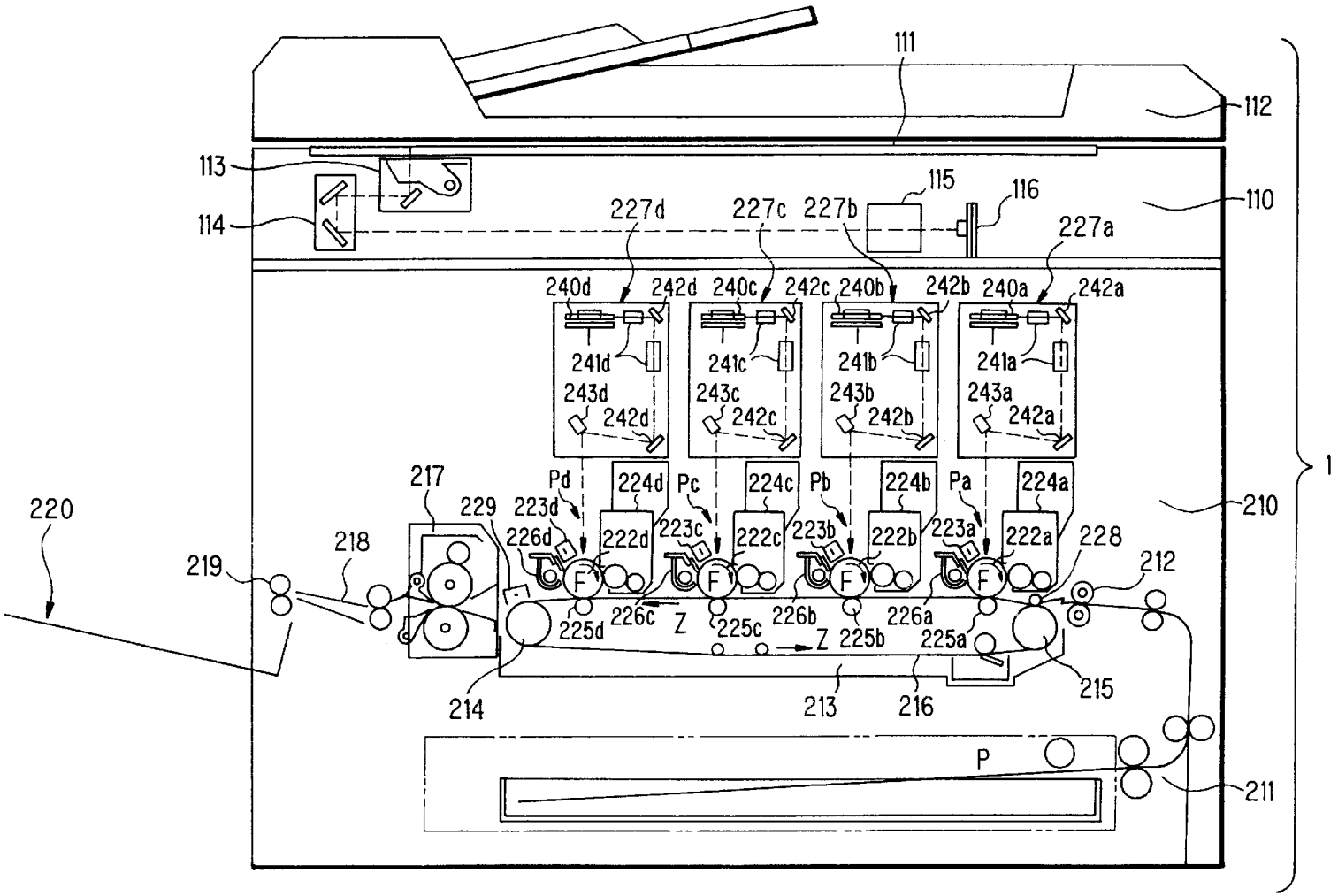
FIG. 1 is a schematic view showing a configuration of a color image forming apparatus in accordance with the first embodiment.

FIG. 1 is a schematic view showing the configuration of a color image forming apparatus according to the first embodiment.

As shown in FIG. 1, the color image forming apparatus according to the first embodiment is comprised of a reversing automatic document feeder (to be referred to as RADF hereinbelow) 112 for pressing an original placed on an original table 111 underneath, an image reading portion 110 and an image forming portion 210 and the like, constituting a copier body 1.

The RADF 112 is a device which first, conveys an original so that one side of the original opposes image reading portion 110 on original table 111 and inverts and conveys the original after the image reading of the first side is completed, so as to read the other side. Then, when image scanning of both sides of one original is completed, the original is discharged and the same cycle of operation is repeated in order to read both sides of a next original.

Image reading portion 110 is disposed below original table 111 in order to read original images and includes a first original scanner unit 113, a second original scanner unit 114, a focusing lens 115 and a photoelectric transducer 116.

First scanner unit 113 is movably supported opposing original table 111 on which the original is placed, and has an unillustrated light source for illuminating the original via original table 111 and a mirror for deflecting the reflected light from the original toward second scanner unit 114. This first scanner unit 113 moves in a reciprocating manner in parallel with, whilst being kept a certain distance away from, the undersurface of original table 111, at the predetermined speed.

Second scanner unit 114 has two mirrors and moves in a reciprocating manner at a speed related to that of first scanner unit 113 and in the same direction. One of the two mirrors is arranged so as to oppose the mirror of first scanner unit 113 and the other opposes focusing lens 115.

Focusing lens 115 reduces the reflected light image from the original, thus deflected by the mirrors of second scanner unit 114, so that the reduced light image is focused on photoelectric transducer 116. Photoelectric transducer 116 is arranged on the opposite side of second scanner unit 114 with focusing lens 115 in-between and photoelectrically converts the focused light image into an electric signal and outputs it. The original image information thus obtained as the electric signal from this photoelectric transducer 116 is further transferred to an unillustrated image processor where it undergoes image data processes.

Image forming portion 210 includes: four image forming units Pa to Pd, a paper feed mechanism 211, a registration roller 212, a transfer and conveyer belt mechanism 213, a fixing unit 217, a conveyance guide 218, discharge rollers 219 and paper output tray 220.

Each of four image forming units Pa to Pd includes a photoreceptor drum 222*a* to 222*d*, a charger 223*a* to 223*d*, a developing unit 224*a* to 224*d*, a transfer charger 225*a* to 225*d*, a cleaning device 226*a* to 226*d* and a laser beam scanner portion 227*a* to 227*d*.

Developing unit 224*a* to 224*d* develops the static latent image formed on photoreceptor drum 222*a* to 222*d*. Transfer charger 225*a* to 225*d* transfers the developed toner image on photoreceptor drum 222*a* to 222*d* to a recording sheet. Cleaning device 226*a* to 226*d* removes the leftover toner from photoreceptor drum 222*a* to 222*d*. These chargers 223*a* to 223*d*, developing units 224*a* to 224*d*, transfer chargers 225*a* to 225*d* and cleaning devices 226*a* to 226*d* are arranged around corresponding photoreceptor drums 222*a* to 222*d*. Here, each of the photoreceptor drums 222*a* to 222*d* rotates in the direction of an arrow F in FIG. 1.

Arranged above photoreceptor drum 222*a* to 222*d* is a laser beam scanner unit 227*a* to 227*d*. Each laser beam scanner unit 227*a* to 227*d* includes: an unillustrated semiconductor laser device for emitting a spot beam modulated in accordance with an image data stream; a deflecting device 240*a* to 240*d* for deflecting the laser beam from the semiconductor laser device, in the main scan direction; a lens group 241*a* to 241*d* (made up of a pair of lenses) for focusing the laser beam deflected by deflecting device 240*a* to 240*d* onto the surface of photoreceptor drum 222*a* to 222*d*; and mirrors 242*a* to 242*d* and 243*a* to 243*d* (made up of a pair of mirrors).

The pixel signal corresponding to the black component image of a color original image is supplied to laser beam scanner unit 227*a*; the pixel signals corresponding to the cyan, magenta and yellow color component image of a color original image are supplied to laser beam scanner units 227*b*, 227*c* and 227*d*, respectively. In this arrangement, the static latent images corresponding to the color separations of the original image information are formed on photoreceptor drums 222*a* to 222*d*.

Developing unit 224*a* holds black toner, developing unit 224*b* holds cyan toner, developing unit 224*c* holds magenta toner and developing unit 224*d* holds yellow toner. The static latent images on photoreceptor drums 222*a* to 222*d* are developed by individual colors of toner. Thus, the color converted, color separations of the original image information are reproduced as toner images of different colors.

Provided at the bottom in image forming portion 210 is paper feed mechanism 211 which separates and feeds recording sheet P, one by one, from a stack of paper held in a paper tray. Registration roller 212 makes control of the timing of conveyance of the recording sheet P, separated and fed by paper feed mechanism 211, to image forming units Pa to Pd.

Transfer and conveyance belt mechanism 213 is arranged under image forming units Pa to Pd, and is constructed of a drive roller 214, an idle roller 215, a transfer and conveyance belt 216 and the like so that the fed recording sheet P is conveyed while it is being electrostatically attracted to transfer and conveyance belt 216. Transfer and conveyance belt 216 is frictionally driven by drive roller 214 in the direction of arrow Z in FIG. 1.

A recording sheet attraction charger 228 electrifies the surface of transfer and conveyance belt 216 so that the recording sheet P delivered from registration roller 212 is attracted to transfer and conveyance belt 216 so as not to cause any displacement between transfer and conveyance belt 216 and recording sheet P during conveyance. An alternating current is applied to an erasing device 229 in order to separate the recording sheet P, which is discharged after an image has been formed through image forming units Pa to Pd, from transfer and conveyance belt 216.

Fixing unit 217 is arranged on the opposite side of registration roller 212 with transfer and conveyance belt mechanism 213 there between and fixes the image, which has been transferred to the recording sheet P, onto recording sheet P. The recording sheet P having passed through the nip between the fixing rollers of this fixing unit 217 proceeds along conveyance guide 218 and is discharged by discharge rollers 219 onto paper output tray 220 which is set on the exterior wall of copier body 1.

In the color image forming apparatus configured as above, cut-sheet type paper is used as recording sheet P. When recording sheet P is delivered into the guide of the paper conveyance path in paper feed mechanism 211, its leading edge is detected by an unillustrated sensor, which outputs a detection signal, based on which registration roller 212 briefly stops the paper.

Then, recording sheet P is delivered in synchronization with image forming stations Pa to Pd, onto transfer and conveyance belt 216 that is rotating in the direction of arrow Z, shown in FIG. 1. At this stage, transfer and conveyance belt 216 has been charged by recording sheet attraction charger 228, so that recording sheet P is stably conveyed through the passage of all the image forming stations Pa to Pd.

In each image forming station Pa to Pd, the toner image of each color is formed so that the different color images are superimposed on the surface of recording sheet P which is conveyed whilst being electrostatically attracted by transfer and conveyance belt 216. When transfer is completed, recording sheet P is separated by virtue of erasing device 229, in a continuous manner starting at its leading edge, from transfer and conveyance belt 216, introduced into fixing unit 217 and finally discharged onto paper output tray 220.

In the above configuration, photoelectric transducer 116 is comprised of a CCD line sensor which photoelectrically converts the focused light image, sequentially, into electric signals. The CCD line sensor is a three-line color CCD which can read monochrome or color images and output line data of color separation components R (red), G (green) and B (blue).

In the above embodiment, RADF 112 is used, but an automatic document feeder for one side only may be used.

Further, instead of the laser beam scanner units 227*a* to 227*d*, another optical system (LED head) made up of a light emitting diode array with a focusing lens array may be used. An LED head is smaller in size compared to laser beam scanner units 227*a* to 227*d* and has no moving parts hence is silent. Therefore, this LED head can be preferably used for tandem type electrophotographic image forming apparatuses which need multiple optical writing units.

<Control of the Color Image Forming Apparatus>

Figure 2:
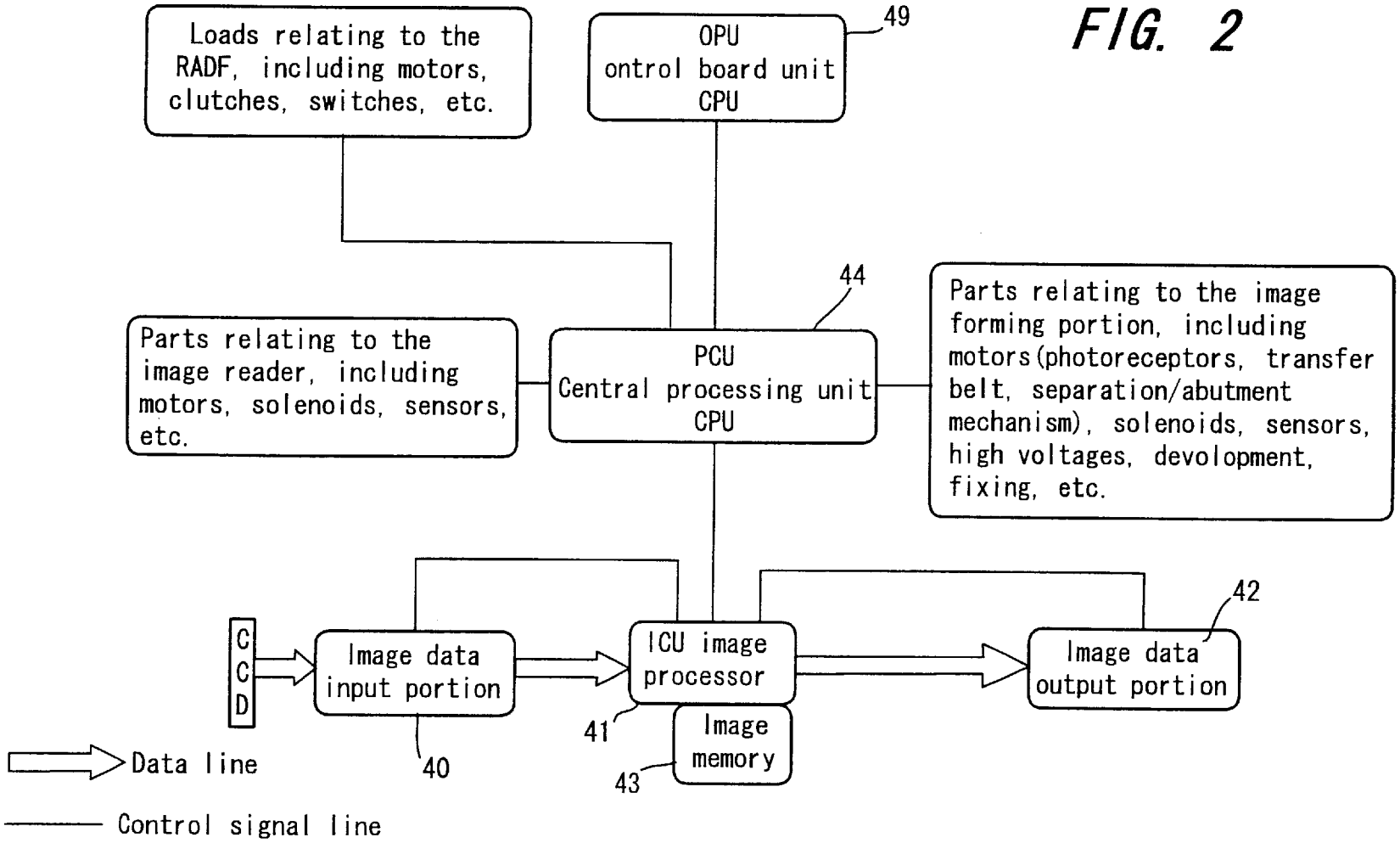
FIG. 2 is an illustrative view showing the control operation of a color image forming apparatus in accordance with the first embodiment.
Figure 6:
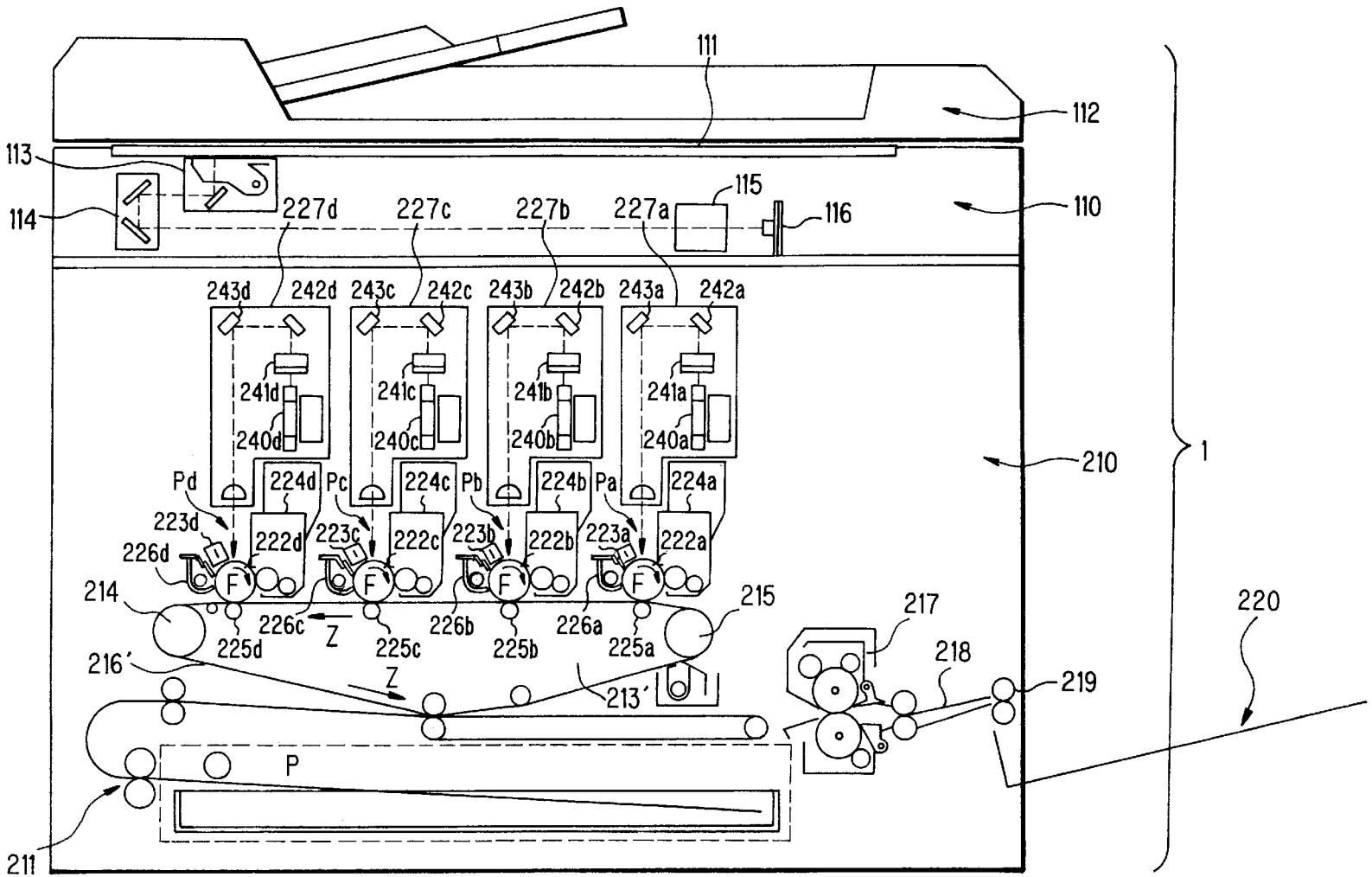
FIG. 6 is a schematic view showing a configuration of a color image forming apparatus in accordance with the second embodiment.

FIG. 2 is an illustrative view showing a state of controlling the operations of different parts of the color image forming apparatus of the first embodiment, by a central processing unit (CPU: corresponding to controller in FIG. 6).

The operation of the color image forming apparatus of the first embodiment is controlled by a central processing unit 44, as shown in FIG. 2.

Central processing unit 44 controls the processing of image data at an image data input portion (corresponding to image reading portion 110) 40, image processor 41, image data output portion (corresponding to image forming portion 210) 42 and image memory 43 and governs the drive mechanisms such as RADF 112, image reading portion 110, image forming portion 210 and the like, which constitute the color image forming apparatus, by sequence control and outputs necessary control signals to each of the drive mechanisms. Illustratively, central processing unit 44 controls start and stop of rotation of photoreceptor drums 222*a* to 222*d*, and separation and abutment of transfer and conveyance belt mechanism 213 and the image forming operation in each image forming mode.

Here, in order to permit image data input portion 40 to handle not only the data input from image reading portion 110 but also deal with image data input from external devices such as PCs (personal computers), it should also have interfaces for them.

Further, central processing unit 44 is connected to a control board unit 49 having a control panel in an intercommunicatable manner. That is, when an operator operates the control panel, the control signal representing the copy mode information input by the operator is transferred to central processing unit 44 so that the whole color image forming apparatus is controlled to operate in the designated mode.

Other than the above, the control panel is used to recover the initialization state (default settings) of the color image forming apparatus and change the control values for each image forming mode. It is also possible for a maintenance person to change the settings through the control panel by inputting hidden codes and the like.

Therefore, if the machine is frequently used for color image forming, it is possible to assign the color image forming mode using all the image forming units as its default image forming mode. On the contrary, if the machine is mostly used for monochrome image forming and rarely used for color image forming, the image forming mode using the monochrome image forming unit only may be set as the default image forming mode.

Further, central processing unit 44 transfers control signals representing various operating states of the color image forming apparatus to control board unit 49 while the control board unit 49 side, based on the control signals, informs the operator of the current status of the color image forming apparatus through the display portion.

<General Image Forming Mode Change>

Next, image forming mode change in the color image forming apparatus of the first embodiment will be described.

As stated already, the color image forming apparatus according to the first embodiment has two changeable modes, specifically, the monochrome image forming mode in which only a single image forming unit Pa is used for image forming and the multi-color image forming mode in which multiple image forming units Pa to Pd are used for image forming.

In the monochrome image forming mode, only the black component image forming unit Pa is set to abut transfer and conveyance belt 216 while other image forming units Pb to Pd for cyan, magenta and yellow colors are kept away from transfer and conveyance belt 216.

Upon mode change from the monochrome image forming mode to the multi-color image forming mode, transfer and conveyance belt mechanism 213 is actuated only after the end of monochrome image forming so as create abutment of all the four image forming units Pa to Pd and transfer to conveyance belt 216.

When the operating mode is switched from the multi-color image forming mode to the monochrome image forming mode, transfer and conveyance belt mechanism 213 is actuated only after the end of multi-color image forming so as to release abutment of the image forming units Pb to Pd for cyan, magenta and yellow colors with transfer and conveyance belt 216.

<Specific Control of Image Forming Mode Change>

Figure 3A:
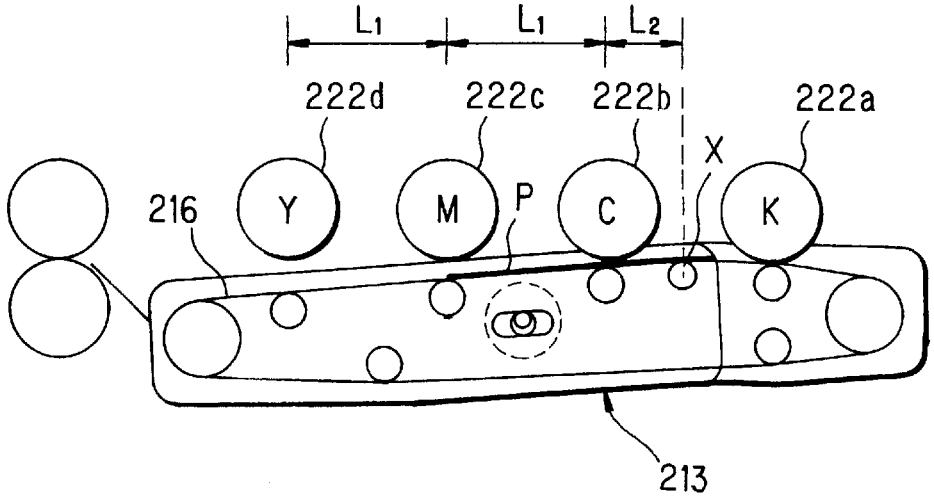
FIGS. 3A to 3C are illustrative views showing different states of a transfer and conveyance belt mechanism with respect to image supports.
Figure 3B:
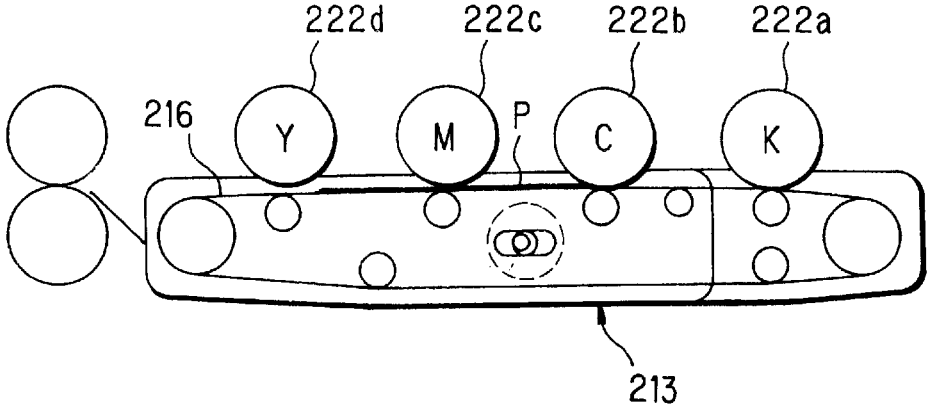
Figure 3C:
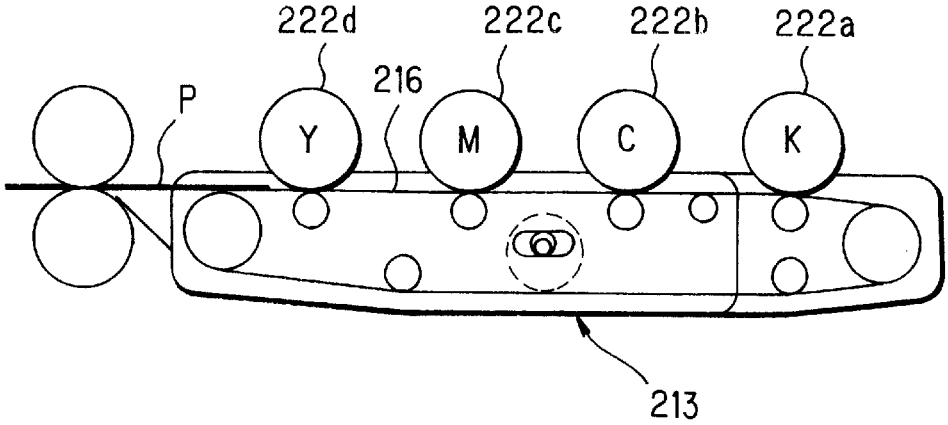

Referring to FIGS. 3A to 3C, specific control of image forming mode change of the first embodiment will be described.

When the operating mode is switched from the monochrome image forming mode to the multi-color image forming mode, it is necessary to change the way the image supports are driven and change the state of abutment/separation of transfer and conveyance belt 216. More specifically, in order to avoid abrasion of the image supports (e.g., photoreceptor drums 222*a* to 222*d*) and transfer and conveyance belt 216 due to sliding contact therebetween, the transfer and conveyance belt 216 is moved to abut against the image supports only after the rotational speed of each image support has reached the predetermined speed.

In the prior art, the movement for abutment is actuated after departure of recording sheet P from transfer and conveyance belt 216 in the monochrome image forming mode. That is, if a change in image forming mode is started during printing, for example, during the state where recording sheet P still remains on transfer and conveyance belt 216, it has been considered that the image on the recording sheet present on the transfer and conveyance belt 216 is adversely affected. More specifically, there has been a risk of stripes arising in the image in the conventional configuration.

Therefore, the time taken from the start of image forming in the monochrome image forming mode to the end of the mode change to the multi-color image forming mode amounts to the sum of the following periods: the time required for forming a black component image, the time required for recording sheet P to pass by the remaining image forming units of cyan, magenta and yellow colors where no image forming is implemented and depart from transfer and conveyance belt 216, and the time required for the image supports to reach the predetermined rotational speed and for transfer and conveyance belt mechanism 213 to move for abutment.

In the color image forming apparatus according to the first embodiment, as soon as image forming of the black component image onto recording sheet P ends, photoreceptor drums 222*b* to 222*d* for cyan, magenta and yellow colors are actuated to turn and the shift of transfer and conveyance belt mechanism 213 is started.

As an example, the rotational speed of photoreceptor drums 222*a* to 222*d* is set at a fixed rate of about 100 mm/s. The time required for photoreceptor drums 222*a* to 222*d* to reach the predetermined rotational speed from their start of rotation and the time required for them to stop their motion from the fixed rotational speed are both relatively short or as short as about 100 ms from the output of the control signal.

On the other hand, it takes 5 to 8 seconds for transfer and conveyance belt mechanism 213 to separate from or abut against photoreceptor drums 222*b* to 222*d* for cyan, magenta and yellow colors because the transfer and conveyance belt mechanism 213 is constituted of many parts and hence heavy and large in size.

FIG. 3A is an illustrative view showing a state (in the monochrome image forming mode) where black component image forming has ended, and the photoreceptor drums 222*b* to 222*d* for cyan, magenta and yellow colors start rotating while the transfer and conveyance belt mechanism 213 remains standing still but is about to move (the state in the monochrome image forming mode).

From the state shown in FIG. 3A, the transfer and conveyance belt mechanism 213 starts moving first. Here, the drive roller side of transfer and conveyance belt 216 rotates about a pivot X.

Black component photoreceptor drum 222*a* is arranged so as to abut transfer and conveyance belt 216 at all times. Photoreceptors 222*b* to 222*d* for other colors, or cyan, magenta and yellow colors abut transfer and conveyance belt 216 in the multi-color image forming mode while they are kept away from transfer and conveyance belt 216 in the monochrome image forming mode.

In the monochrome image forming mode, photoreceptor drums 222*b* to 222*d* for cyan, magenta and yellow colors do not make any rotational motion.

FIG. 3B is an illustrative view showing a state where transfer and conveyance belt mechanism 213 has already started moving while recording sheet P has just passed through photoreceptor drum 222*b* for cyan. FIG. 3C is an illustrative view showing a state where recording sheet P has just passed through yellow color photoreceptor drum 222*d*.

When transfer and conveyance belt mechanism 213 has already started moving and recording sheet P has just passed through cyan color photoreceptor drum 222*b*, photoreceptor drums 222*b* to 222*d* for cyan, magenta and yellow colors have not yet abutted on the transfer and conveyance belt 216.

Then, as shown in FIG. 3C, only when recording sheet P has passed through yellow color photoreceptor drum 222*b*, photoreceptor drums 222*b* to 222*d* for cyan, magenta and yellow abut transfer and conveyance belt 216 at the same time.

With this arrangement, it becomes possible to start multi-color image forming immediately after the recording sheet P has passed through photoreceptor drums 222*b* to 222*d*.

In sum, photoreceptor drums 222*b* to 222*d* for cyan, magenta and yellow colors, which have remained stationary, starts rotating during the period from the state shown in FIG. 3A to the state shown in FIG. 3C and are controlled so as to rotate at the same speed as that of transfer and conveyance belt 216 immediately before the state shown in FIG. 3C or photoreceptor drums 222*b* to 222*d* which have been kept away from transfer and conveyance belt 216 abut transfer and conveyance belt 216.

As an example of settings, in the separated state, the clearance of transfer and conveyance belt 216 from cyan color photoreceptor drum 222*b*, which is the closest one to pivot X is set at about 2 mm while the clearance of transfer and conveyance belt 216 from yellow color photoreceptor drum 222*d* which is the farthest one from pivot X is set at about 10 mm. Further, the interval L1 between adjacent photoreceptor drums 222*b* to 222*d* is set at 100 mm. The pivot X is arranged at an approximate center between cyan color photoreceptor drum 222*b* and black component photoreceptor drum 222*a*, so that L2 is set at 50 mm.

In this case, it takes only 3 seconds after the completion of transfer of the black image to the recording sheet P, for the rear end of recording sheet P to pass through the most downstream photoreceptor drum 222*d*. At this point of time, the clearances of photoreceptor drums 222*b* to 222*d*, which are unused for image forming, to the recording sheet P on transfer and conveyance belt 216 still remain 40% to 62% of the gap when transfer and conveyance belt mechanism is actuated to move. Therefore, it is possible to start upward movement of transfer and conveyance belt mechanism 213 immediately after completion of transfer of the black image to recording sheet P (immediately after when recording sheet P has totally departed from black component photoreceptor drum 222*a*).

As already stated, the time required for photoreceptor drums 222*b* to 222*d* to reach the predetermined rotational speed is short compared to the time required for transfer and conveyance belt mechanism 213 to completely shift. Accordingly, if photoreceptor drums 222*b* to 222*d* are actuated to rotate after transfer and conveyance belt mechanism 213 starts moving, the rotational speed of photoreceptor drums 222*b* to 222*d* will have reached the fixed speed when the belt abuts the drums. Therefore, there is no risk of the surfaces of photoreceptor drums 222*b* to 222*d* rubbing transfer and conveyance belt 216.

If the rotating time of photoreceptor drums 222*b* to 222*d* should be set as short as possible, the start time for rotation of photoreceptor drums 222*b* to 222*d* can be set up by making a calculation based on the timing of transfer and conveyance belt 216 abutting photoreceptor drums 222*b* to 222*d* and the time required for photoreceptor drums 222*b* to 222*d* to perfectly reach the fixed speed. Here, control of separation and abutment actions of transfer and conveyance belt 216 can be made by detecting the position of the transfer and conveyance belt 216 using an unillustrated detector and based on this detected position.

Figure 4:
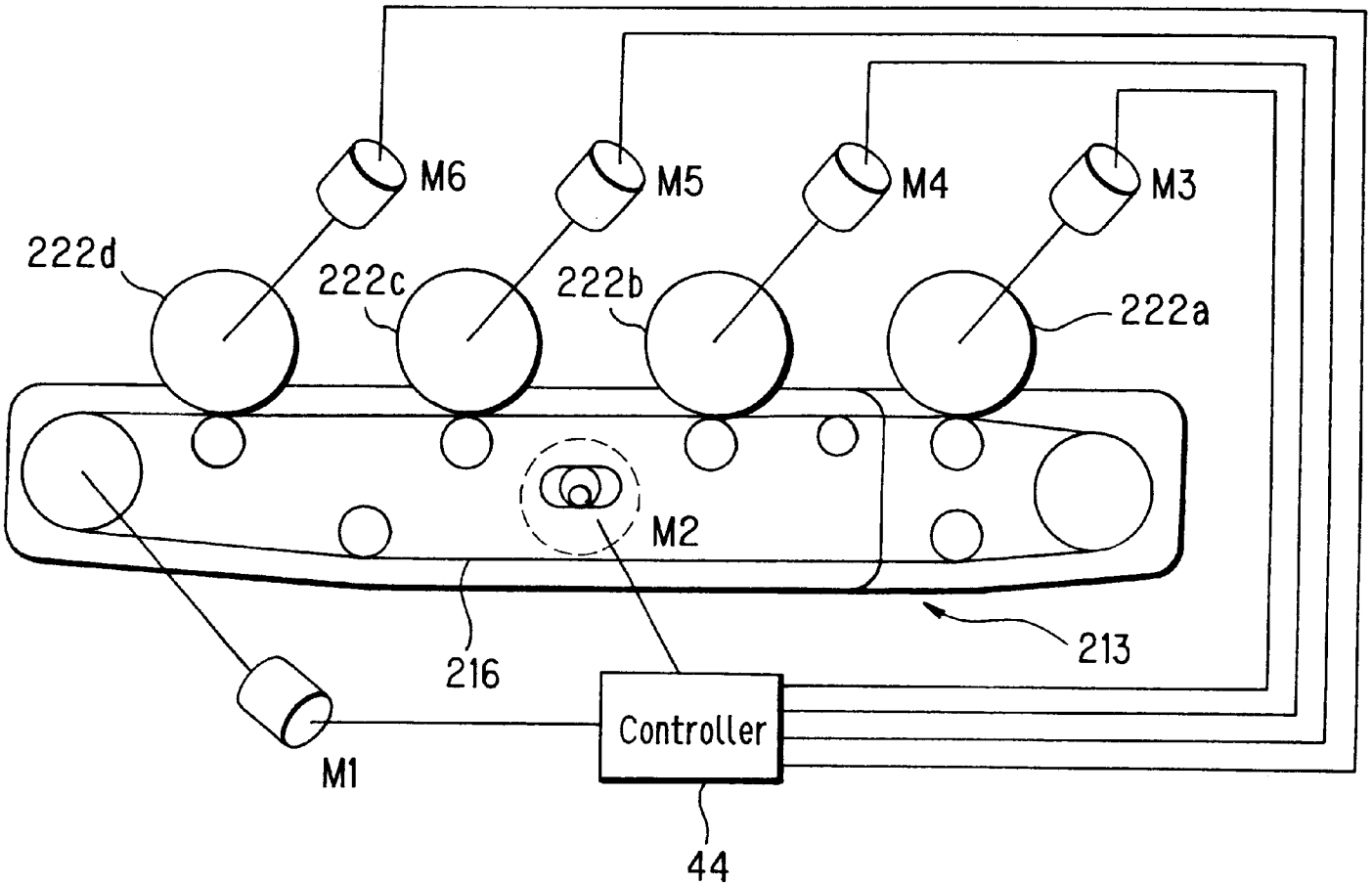
FIG. 4 is an illustrative view showing a control system of drive motors for a transfer and conveyance belt and drive motors for image supports.

FIG. 4 is an illustrative view showing a control system of the drive motors for transfer and conveyance belt 216 and the drive motors for photoreceptor drums 222*a* to 222*d*.

The operation timing of a motor M1 for driving transfer and conveyance belt 216, a motor M2 for actuating the separation/abutment mechanism and motors M3 to M6 for rotating photoreceptor drums 222*a* to 222*d* is controlled by common controller 44, as shown in FIG. 4. Further, adoption of stepping motors for these motors M1 to M6 makes it possible to perform high precision speed and positional control by an open-loop configuration, hence readily controlling the operations in a correct timing sequence.

Referring next to the flowchart shown in FIG. 5, the aforementioned control operation will be described.

Figure 5:
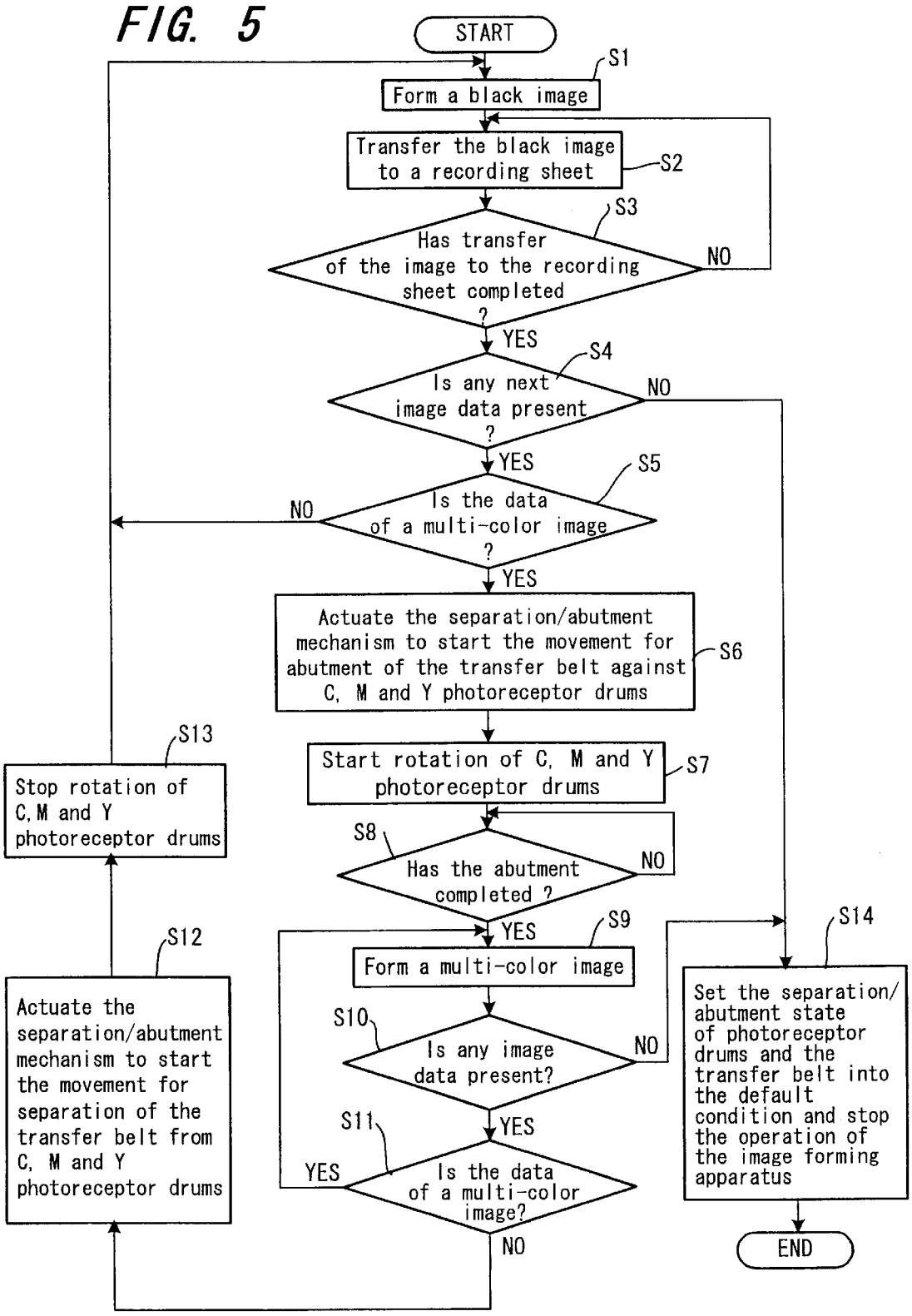
FIG. 5 is a flowchart showing the control operation in a color image forming apparatus in accordance with the first embodiment.

In the color image forming apparatus of the first embodiment, as shown in FIG. 5, a black (K) toner image is formed on the surface of photoreceptor drum 222*a*(S1). Then, the black (K) toner image (black image) is transferred to recording sheet P (S2).

Thereafter, it is judged whether the image transfer to recording sheet P is completed (S3). If the transfer is not completed, the operation returns to Step 2 (S2). If the transfer is completed, it is checked whether a next page of image data exists (S4).

If no next image data is present, the separation/abutment state of photoreceptor drums 222*b* to 222*d* and transfer and conveyance belt 216 is set into the default condition and then the operation of the color image forming apparatus is stopped (completed) (S14).

On the other hand, if there is a next page of image data, it is checked whether the image data is for a multi-color image (S5). If the image data is not for a multi-color image, the operation returns to Step 1 (S1). If the image data is of a multi-color image, the separation/abutment mechanism is actuated so as to start abutment movement between transfer and conveyance belt 216 and C, M and Y photoreceptor drums 222*b* to 222*d* (S6).

Then, C, M and Y photoreceptor drums 222*b* to 222*d* start rotating (S7), and it is checked whether abutment of transfer and conveyance belt 216 against photoreceptor drums 222*b* to 222*d* is completed (S8).

This step is repeated until the abutment between transfer and conveyance belt 216 and photoreceptor drums 222*b* to 222*d* is complete. When the abutment is complete, multi-color image forming is implemented (S9).

Subsequently, it is checked whether a next page of image data exists (S10). If no next image data is present, the separation/abutment state of photoreceptor drums 222*b* to 222*d* and transfer and conveyance belt 216 is set into the default condition and then the operation of the color image forming apparatus is stopped (completed) (S14).

If there is a next page of image data, it is checked whether the image data is for a multi-color image (S11). If the image data is of a multi-color image, the operation returns to Step 9 (S9). If the next page of image data is not a multi-color image, the separation/abutment mechanism is actuated so as to start separating transfer and conveyance belt 216 from C, M and Y photoreceptor drums 222*b* to 222*d* (S12). Then, the C, M and Y photoreceptor drums 222*b* to 222*d* are stopped rotating (S13) and the operation returns to Step 1 (S1).

The initial condition at the start of image forming may be set either in the monochrome image forming mode or the multi-color image forming mode, and it is preferred that the initial condition can be selected as appropriate by the user.

<The Second Embodiment>

Referring to FIG. 6, a color image forming apparatus according to the second embodiment of the present invention will be described.

FIG. 6 is a schematic view showing the configuration of a color image forming apparatus in accordance with the second embodiment. In FIG. 6, the parts having the same functions as those in the first embodiment are allotted with the same reference numerals.

The above-described color image forming apparatus of the first embodiment uses transfer and conveyance belt mechanism (transfer and conveyance support) 213 as a transfer support, while the color image forming apparatus of the second embodiment includes an intermediate belt (intermediate transfer support) as a transfer support.

As shown in FIG. 6, the color image forming apparatus according to the second embodiment has an intermediate transfer belt 216' arranged between image forming units Pa to Pd and a conveyer belt unit 213' (corresponding to transfer and conveyance belt mechanism 213).

This intermediate transfer belt 216' has K, C, M and Y images transferred from image forming units Pa to Pd to complete a color image on the surface thereof, then it transfers the compete color image to a recording sheet P.

Since the configuration other than the intermediate transfer belt 216' is almost the same as that of the color image forming apparatus according to the first embodiment (see FIG. 1) though the layout of some components and means may be to a certain extent different, the detailed description is omitted. Similarly, the control of the color image forming apparatus of the second embodiment, including the scheme of image forming mode change is also almost the same as the above-described color image forming apparatus of the first embodiment, so the description is omitted.

In this way, the color image forming apparatus of the second embodiment having intermediate transfer belt 216' is also able to change its operation between the monochrome image forming mode and the multi-color image forming mode, readily and quickly.

<The Third Embodiment>

The color image forming apparatus according to the third embodiment of the present invention has almost the same configuration as that of the color image forming apparatus of the first embodiment described above, and using a different control sequence in order to reduce the time up to the end of change in image forming mode.

In order to reduce the time to the end of change in image forming mode (improve the processing speed of printing), the color image forming apparatus according to the third embodiment is controlled as follows.

Referring to FIGS. 7A to 7D, a specific control example of changing the image forming mode in the third embodiment will be described.

In a case where a printing operation in the monochrome image forming mode (mono-color image forming mode) ends and a next printing operation in the color image forming mode (multi-color image forming mode) starts, the transfer and conveyance belt moves and needs to abut the image forming units Pb to Pd for multi-color image forming mode and the image forming unit Pa used in the monochrome image forming mode, under the same conditions (each photoreceptor drum should be put into contact with the transfer and conveyance belt under the same contact pressure as the others).

Figure 7A:
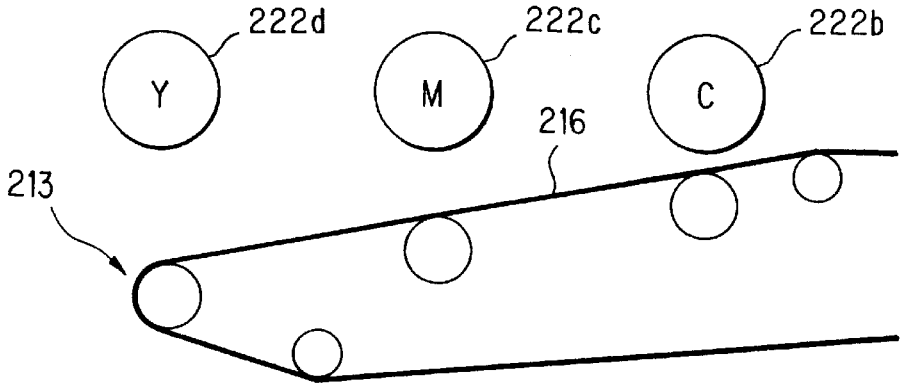
FIGS. 7A to 7D are illustrative views showing a specific control of image forming mode change in the third embodiment.

FIG. 7A shows one situation of the aforementioned moving process, i.e., the position of transfer and conveyance belt 216 and the clearances of image forming units Pb to Pd for multi-color image forming mode with respect to the belt, immediately after transfer of the image information in the monochrome mode from image forming unit Pa for the monochrome image forming mode to recording sheet P.

Next, when transfer of the image up to the rear end of recording sheet P is detected at the transfer portion of image forming unit Pa used in the monochrome image forming mode, the controller issues a command to the drive source for moving transfer and conveyance belt 216 so as to cause the drive source to rotate to raise transfer and conveyance belt 216. By this command, transfer and conveyance belt 216 rotates about pivot X and moves upwards.

Figure 7B:
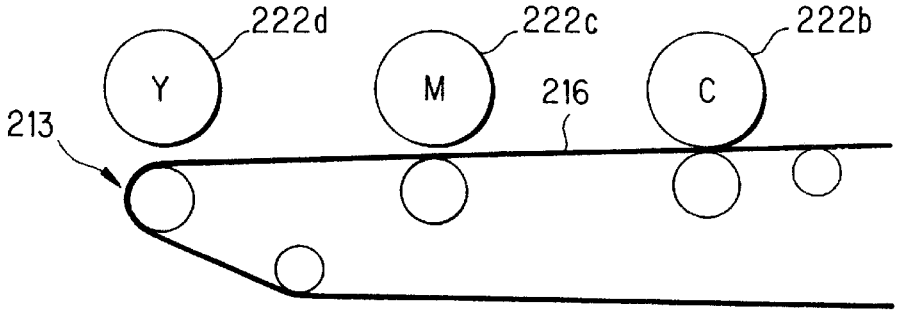
Figure 7C:
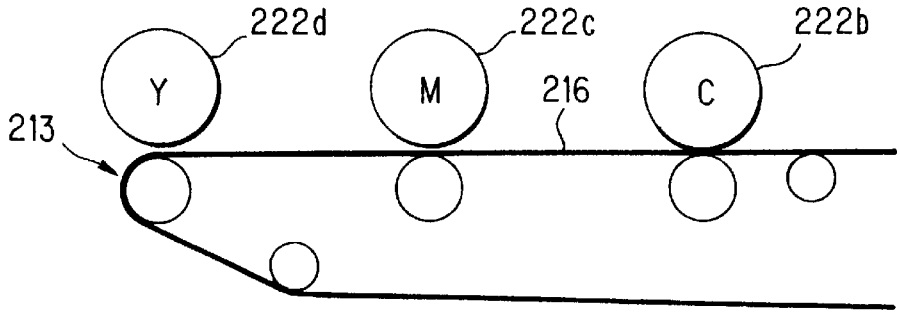
Figure 7D:
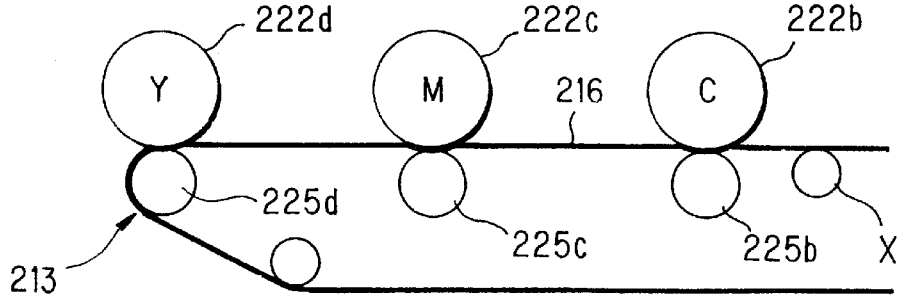

Then, as shown in FIG. 7B, the cyan (C) color photoreceptor drum 222*b* adjacent to the image forming unit Pa used in the monochrome image forming mode and transfer and conveyance belt 216 come into contact. In the same manner, as shown in FIGS. 7C and 7D, magenta (M) color photoreceptor drum 222*c* and yellow (Y) color photoreceptor drum 222*d* successively come into contact with transfer and conveyance belt 216.

In a usual case where the transfer and conveyance belt entirely moves upwards in parallel, the C, M and Y color photoreceptor drums 222*b* to 222*d* will all abut transfer and conveyance belt 216 at almost the same time. On the contrary, when the pivot point X is located between the cyan (C) color image forming unit Pb and black component image forming unit Pa as in the third embodiment, the order of abutment is predetermined such as the cyan (C) photoreceptor drum 222*b* abuts transfer and conveyance belt 216 first and the yellow (Y) color photoreceptor drum 222*d* abuts transfer and conveyance belt 216 last.

In the above case where the order of image forming units Pb to Pd abutting transfer and conveyance belt 216 is predetermined and the lifting time of transfer and conveyance belt 216 is determined, if control is made such that a next printing step is started after transfer and conveyance belt 216 has abutted all the image forming units Pb to Pd as in the prior art, this control results in reduction in printing speed.

Therefore, in the third embodiment, the rotational speed (the speed of conveyance of recording sheets) of transfer and conveyance belt 216 is increased during the period from when the rear end of recording sheet P passes through image forming unit Pa used in the monochrome image forming mode until transfer and conveyance belt 216 abuts the adjacent cyan (C) color image forming unit Pb, so as to shorten the time to a next start of printing.

Figure 8A:
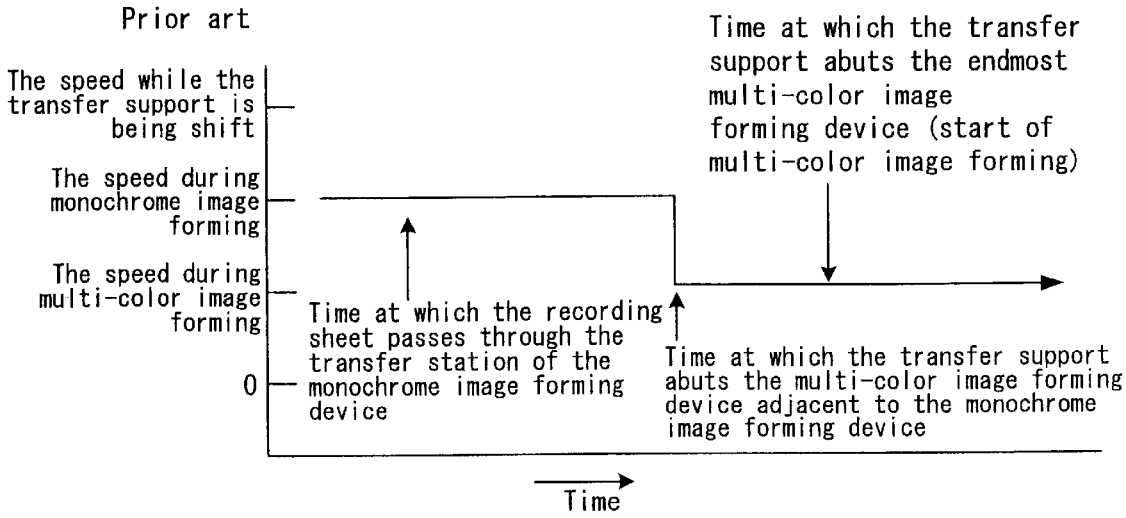
FIG. 8A PRIOR ART
FIGS. 8A and 8B are illustrative views for illustrating the difference between the speed shift control of the transfer and conveyance belt in a conventional configuration and that of the third embodiment.
Figure 8B:
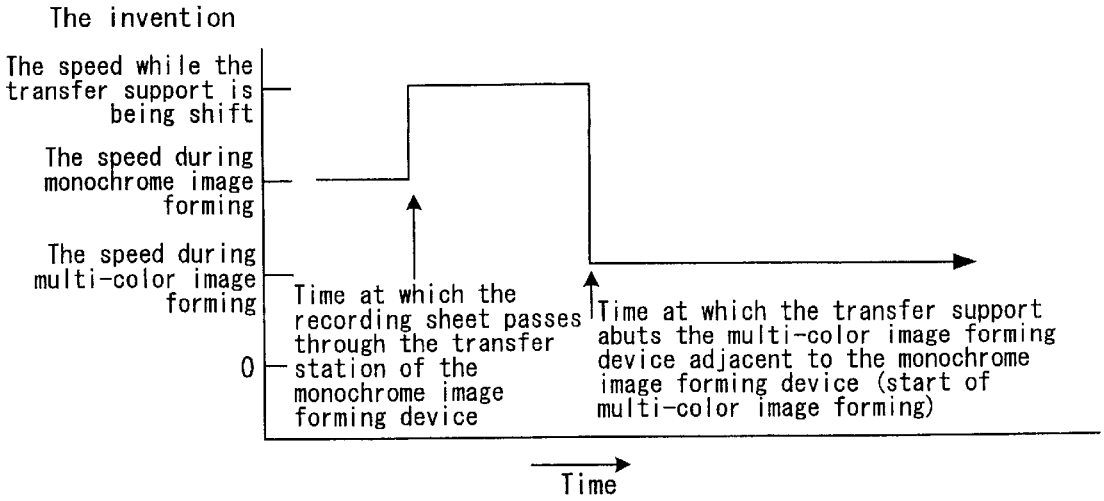

FIGS. 8A and 8B show speed changes of transfer and conveyance belt 216 in the monochrome image forming mode, during the mode change and in the multi-color image forming mode. FIG. 8A is an illustrative view showing the speed changes of transfer and conveyance belt 216 in the prior art; and FIG. 8B is an illustrative view showing the speed changes of transfer and conveyance belt 216 in the third embodiment.

As is obvious from FIGS. 8A and 8B, in the comparison with the prior art, transfer and conveyance belt 216 is rotated at a higher rate during the period from when recording sheet P passes through image forming unit Pa used in the monochrome image forming mode until transfer and conveyance belt 216 abuts the adjacent cyan (C) color image forming unit Pb, whereby it is possible to enhance the speed of printing.

In this case, it is preferred that the period for speedup of transfer and conveyance belt 216 is set at least until the rear end of recording sheet P passes through cyan (C) color image forming unit Pb. That is, controlling the system such that recording sheet P has completely passed through the abutment when cyan (C) image forming unit Pb and transfer and conveyance belt 216 abut each other, makes it possible to prevent recording sheet P from being rubbed at that abutment and prevents unfixed developer from being disturbed as well as avoids occurrence of re-transfer problems at the cyan (C) color image forming unit Pb.

Further, it is especially preferred that the period for high speed conveyance is set until the rear end of recording sheet P passes through the abutment between transfer and conveyance belt 216 and the endmost color image forming unit Pd used in the multi-color image forming mode. The high speed conveyance during that period makes it possible to positively prevent recording sheet P from being rubbed at that abutment and avoid occurrence of re-transfer problems.

Hereupon, to increase the rotational speed of transfer and conveyance belt 216 for change in image forming mode, the following three problems have to be solved.

The first problem is that image forming units Pa to Pd deteriorate due to abrasion by the abutment of transfer and conveyance belt 216 which is rotating at a high speed.

To deal with this problem, the rotational speed of the rotational elements (including photoreceptor drums 222*a* to 222*d*, developer sleeves, cleaning rollers and the like) of image forming units Pa to Pd need to be set at a speed equal to or greater than, and not greater than 1.2 times of, the conveying speed of the speeded up transfer and conveyance belt 216.

If the rotational speed of the rotational element of each image forming unit Pa to Pd is set at a speed lower than the conveyance speed of transfer and conveyance belt 216, the transfer and conveyance belt 216 which has a larger surface roughness than that of photoreceptor drums 222*a* to 222*d* rubs photoreceptor drums 222*a* to 222*d* and produces damage to the surfaces of photoreceptor drums 222*a* to 222*d*.

Therefore, this problem should be solved by adjusting the peripheral speed of each photoreceptor drum 222*a* to 222*d* to the same speed as transfer and conveyance belt 216 so that the line speed of photoreceptor drum 222*a* to 222*d* and that of transfer and conveyance belt 216 become equal to one another at each transfer position of image forming unit Pa to Pd where the two elements will abut.

Further, in addition to change in the peripheral speed of photoreceptor drums 222*a* to 222*d*, the elements which are arranged around photoreceptor drums 222*a* to 222*d* and rotate in synchronization with the speed of photoreceptor drum 222*a* to 222*d*, e.g., developer sleeves, cleaning rollers and the like, may also be increased in rotational speed, whereby it is possible to solve the above problem more efficiently.

The second problem relates to application of voltage for charge erasing to transfer and conveyance belt 216.

In a normal printing process, transfer and conveyance belt 216 is charged (by the transfer voltage applied to the transfer roller). In order to erase electric charge from transfer and conveyance belt 216 and reset it to the initial condition, an erasing voltage application means is provided. This erasing voltage is set taking into account the transfer voltage, triboelectric potential generated by the drive roller and idle roller and the cleaning blade for cleaning off the transfer and conveyance belt 216, all being in rubbing contact with the transfer and conveyance belt 216 when it rotates.

For the configuration thus set up, when transfer and conveyance belt 216 is rotated at high speeds, the triboelectric potential increases and this makes it difficult to initialize the transfer and conveyance belt 216 by the normal erasing voltage application. As a result, the friction of the belt with the drive roller and the like increases, causing transfer and conveyance belt 216 to meander with respect to the normal position.

Further, if a next printing process is implemented under conditions in which the potential of transfer and conveyance belt 216 could not be initialized, the normal transfer voltage cannot be applied to the paper, photoreceptor drums 222*a* to 222*d* and the like, causing printing failures. For these reasons, it is necessary to apply a higher erasing voltage compared to the normal condition to the transfer and conveyance belt 216 that is rotating at the higher speed. Similarly, the same countermeasure should be taken for the speeded up, image forming units Pa to Pd and photoreceptor drums 222*a* to 222*d*.

The third problem relates to the recording sheet to be conveyed on the transfer and conveyance belt 216 which is rotating at the high speed.

Specifically, when transfer and conveyance belt 216 is rotated at a higher speed, the recording sheet P on the transfer and conveyance belt 216 is also conveyed at that speed. In usual color image forming apparatuses, in order to make the machine size compact, the fixing mechanism, located next to the image forming portion, is arranged a distance scarcely greater than the maximum length of recording sheet P to be printed, apart from the endmost image forming unit Pd.

Figure 9A:
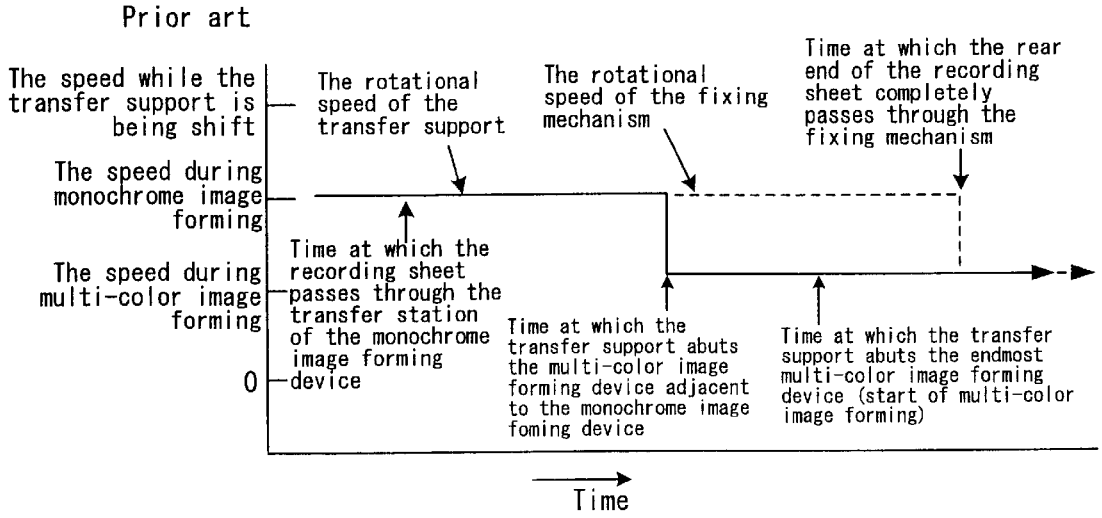
FIG. 9A PRIOR ART
FIGS. 9A and 9B are illustrative views for illustrating the difference between the speed shift control of the transfer and conveyance belt and fixing mechanism in the conventional configuration and that of the third embodiment.

Under this condition, if transfer and conveyance belt 216 is rotated at the high speed, the leading part of recording sheet P with an image printed thereon may enter the fixing mechanism while it is driven at the high speed. In this situation, if the speed of conveyance of the recording sheet P once having entered the fixing mechanism is reduced to the normal speed because the abutment between transfer and conveyance belt 216 and the image forming units Pb to Pd having been made, the speed of the recording sheet P changes while it is passing through the fixing mechanism. As a result, the amount of heat which the recording sheet P receives from the fixing mechanism varies, hence a printed image with variation in fixing performance might be put out to the user (see FIG. 9A). That is, one recording sheet P may have parts different in fixing performance, giving rise to a problem of one printed article having varying glossiness and varying fixing performance.

Figure 9B:
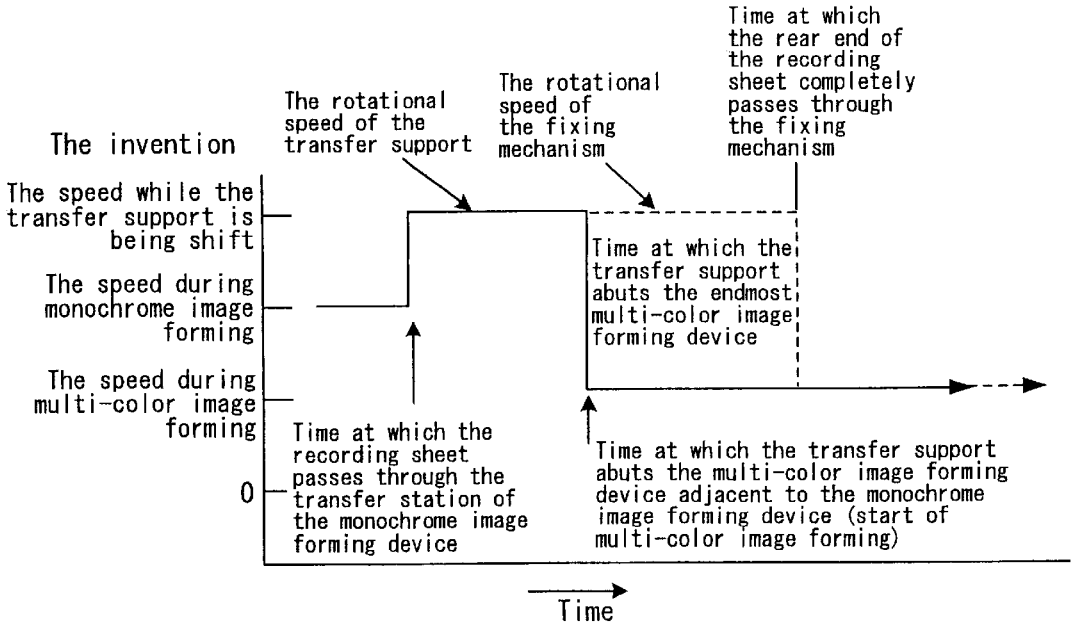

To avoid the above problem, it is necessary to keep the conveying speed of recording sheet P at the high speed until the rear end of recording sheet P passes through the fixing mechanism if the leading end of recording sheet P has once entered the fixing mechanism during its high speed period, as shown in FIG. 9B.

Thus, this control makes it possible to provide printed articles excellent in glossiness and fixing performance.

Next, the control operation of the color image forming apparatus according to the third embodiment will be described.

Figure 10:
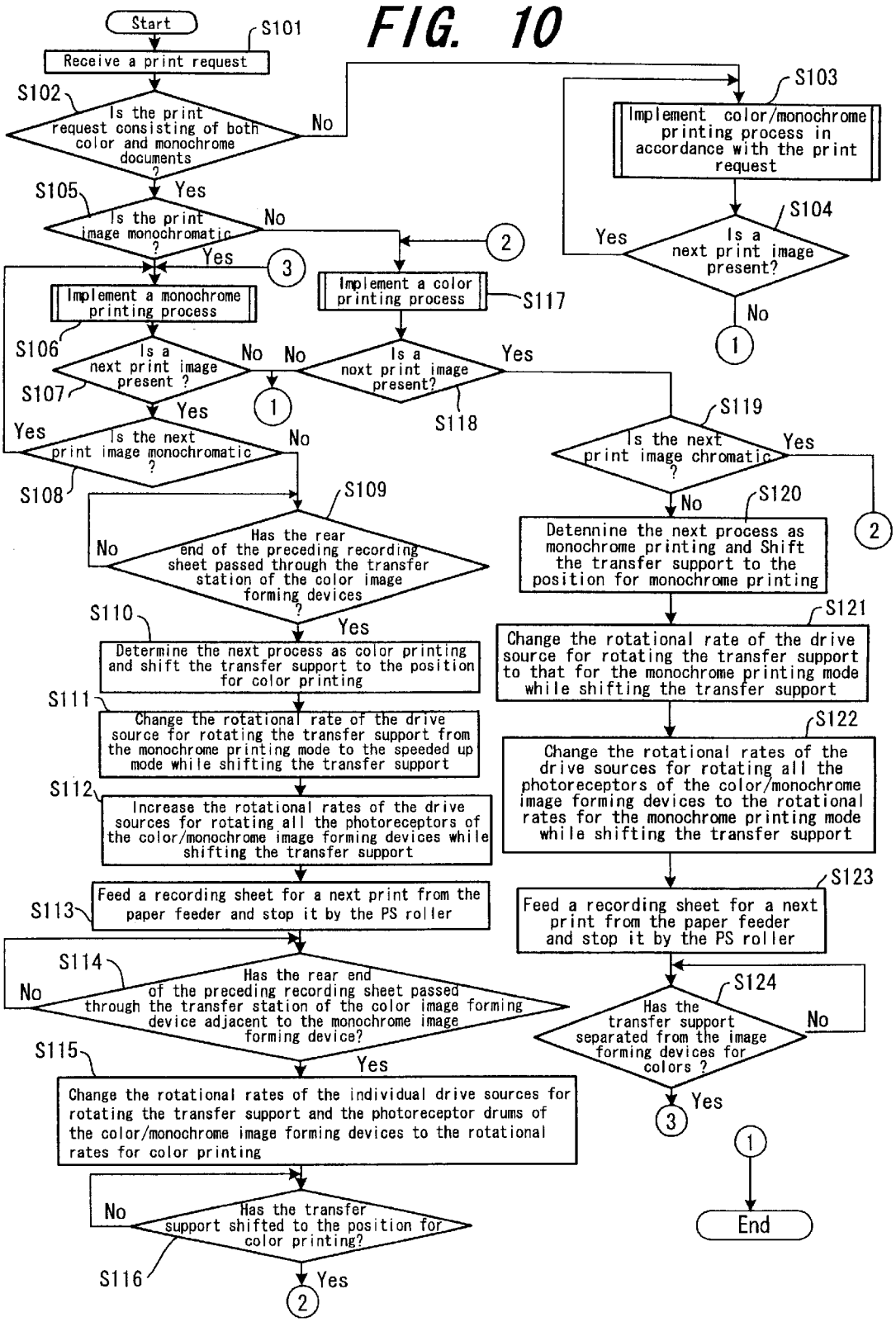
FIG. 10 is a flowchart showing the control operation in a color image forming apparatus in accordance with the third embodiment.

FIG. 10 is a flowchart showing the control operation in the color image forming apparatus according to the third embodiment.

To implement a printing operation in the color image forming apparatus of the third embodiment, the apparatus receives print requests, either, from a user who sets documents in the image reading portion (scanner portion) first and then inputs printing conditions through the control portion or from print requests from multiple terminal units (S111).

Next, the type of the print request is determined, that is, whether the print request is a task consisting of color documents only, a task consisting of monochrome documents only or a task for documents consisting of both color and monochrome documents (S102). Upon this determination, the judgement as to a print request from the scanner portion is made based on the print request content from the control portion whereas the judgement as to a print request from a terminal device is made based on all transmission of image information or printing conditions.

Herein, when the print request is determined to be a task consisting of color documents only or monochrome documents only, an appropriate printing process in agreement with the color designation is performed (S103 and S104). In contrast, when the print request is determined to be a task consisting of both color and monochrome documents, whether the first document is a color or monochrome one is determined (S105).

Herein, when the first document is determined to be a monochrome one, a monochrome printing process is implemented (S106) and it is checked whether a next document is present or not (S107). When a next document is present, it is determined whether the document is a monochrome one (S108). Here, when the next document is a monochrome one, the operation returns to Step 106 as stated above (S108). When the next document is a color one, the arrangement of the parts and the printing conditions are changed into the color printing mode, in order to implement color document printing.

This means that transfer and conveyance belt 216 is actuated to move and get ready for color printing. Hereupon, the shift of transfer and conveyance belt 216 has to be started after the rear end of recording sheet P has passed through the image forming unit Pa which is used in the monochrome image forming mode. Therefore, the upward shift of transfer and conveyance belt 216 starts after checking the position of recording sheet P and only after the above conditions are satisfied (S109, S110).

Further, in order to shorten the time for the printing process, the conveyance of transfer and conveyance belt 216 is speeded up while transfer and conveyance belt 216 is moving upward (S111). At the same time, all the photoreceptor drums 222*a* to 222*d* to be abutted on transfer and conveyance belt 216 during the printing process are increased in rotational speed (S112). In addition to speeding up the photoreceptor drums 222*a* to 222*d*, all the elements (e.g., developer sleeves, cleaning rollers, etc.) that are in contact with any of photoreceptor drums 222*a* to 222*d* are speeded up with respect to their rotational rate.

Further, at the Steps 111 and 112 (S111, S112) the voltages to be applied to charge erasing devices for photoreceptor drums 222*a* to 222*d* and transfer and conveyance belt 216 are increased compared to the applied voltages during the normal printing process. In this way, by increasing the applied voltage to each erasing device, it is possible to prevent degradation of the developer, abnormal adhesion of the developer to the cleaning roller, the residual potential increase on the photosensitive layer due to triboelectricity, and the like. In sum, since transfer and conveyance belt 216 has an inherent resistance, the residual potential in transfer and conveyance belt 216 increases due to speedup of rotation, which may cause transfer and conveyance belt 216 to meander or which causes insufficient application of transfer voltage for the next cycle and may cause print quality degradation due to transfer failures. The above countermeasure, i.e., increase of the applied voltage to each erasing device, makes it possible to avoid these problems.

While transfer and conveyance belt 216 is moved upward to be ready for color printing with its rotational speed and the rotational speeds of each image forming unit Pa to Pd increased, a recording sheet for a next page is fed by paper feed mechanism 211 to the PS roller (idle roller), waiting for the start of printing (S113).

When transfer and conveyance belt 216 moving up whilst rotating at the high speed abuts the color image forming unit Pb adjacent to the image forming unit Pa used in the monochrome image forming mode or when the rear end of recording sheet P being conveyed on transfer and conveyance belt 216 is confirmed to have passed through the transfer station (S114), the speed of conveyance of transfer and conveyance belt 216 and the rotational speeds of image forming units Pa to Pd are reduced to the level for multicolor image forming (S115). The reason why the rotational speed of each image forming unit Pa to Pd is lowered is that if photoreceptor drums 222*a* to 222*d* continue to rotate at the high speed while they are abutting against transfer and conveyance belt 216, photoreceptor drums 222*a* to 222*d* and transfer and conveyance belt 216 rub each other, causing the aforementioned problem. Further, continuation of high speed rotation more than needed will delay the start of the following color printing operation, resulting in reduction in printing speed.

When all preparations for color printing are made in the above way, it is verified as the final check as to whether transfer and conveyance belt 216 has completely moved up (S116). When the upward movement of transfer and conveyance belt 216 ends, the printing operation of a color image is started.

Next, at Step 105 (S105), when the first document is determined to be a color image, a color printing process is implemented (S117) and it is checked whether a next document is present or not (S118). If a next document is present and it is determined whether the document is a color one (S119). Here, when the next document is a color one, then the operation returns to Step 117 (S119).

When the next document is a monochrome one, the arrangement of the parts and the printing conditions are changed into the monochrome printing mode, in order to implement monochrome document printing. Specifically, transfer and conveyance belt 216 is actuated to move (down). Hereupon, the shift of transfer and conveyance belt 216 has to be started after the rear end of recording sheet P has passed through the transfer portion of the endmost image forming unit Pd. Therefore, the downward shift of transfer and conveyance belt 216 starts after checking the position of recording sheet P and only after the above conditions are satisfied (S120).

Further, in order to speed up the printing process, the speed of conveyance of transfer and conveyance belt 216 is shifted to that for the monochrome mode while transfer and conveyance belt 216 is moving down (S121). At the same time, the photoreceptor drum 222*a* to be abutted against transfer and conveyance belt 216 during the printing process is switched to that for the monochrome mode (S122). This change of the rotational speed of photoreceptor drum 222*a* is implemented for the same reason as Step 112 (S112) described above.

Subsequently, a recording sheet for a next page is fed by paper feed mechanism 211 to the PS roller (idle roller), waiting for the start of printing (S123).

Thus, in the monochrome mode, transfer and conveyance belt 216 which is moving down is confirmed to have separated from the image forming unit Pb adjacent to the image forming unit Pa used for the monochrome image forming mode (S124), and the printing process for a monochrome image is implemented (S106).

As has been described, it is possible to shorten the time before the start of a next printing operation by increasing the rotational rate of transfer and conveyance belt 216 while it is shifting, whereby it is possible to reduce the total printing time of one print job session as well as to stand ready for a next process without waiting the time for transfer and conveyance belt 216 to move.

Nevertheless, since mere speedup of the rotational rate of transfer and conveyance belt 216 causes deterioration of the color image forming apparatus and degrades print quality, all the elements arranged near transfer and conveyance belt 216 and around photoreceptor drums 222*a* to 222*d* should be of course adjusted in compliance with the features of the present invention.

Though the control of the mode change in the above embodiment is started after the end of transfer to the recording sheet, the mode change may be implemented by time control based on the time of the start of conveyance of the recording sheet or based on the time when the recording sheet has completely passed through the image forming station engaged in the image forming.

The color image forming apparatus and its control method according to the present invention is thus configured so that the following effects can be obtained.

First, according to the color image forming apparatus and its control method of the present invention, while the recording sheet yet remains on transfer support, the mode change from the monochrome image forming mode to the multi-color image forming mode is carried out. Accordingly, it is possible to start the mode change to the multi-color image forming mode earlier than in the conventional color image forming apparatus in which the image forming mode change is started only after the recording sheet has passed through the transfer support. As a result, it is possible to shorten the time required for a total image forming job without changing the order of image forming even when the job consists of both monochrome and multi-color images.

According to the color image forming apparatus and its control method of the present invention, change in image forming mode is started immediately after the image formed at the image forming device to which the recording sheet being conveyed reaches first has been transferred from the image support to the recording sheet. Accordingly, it is possible to start the mode change to the multi-color image forming mode earlier than in the conventional color image forming apparatus. As a result, it is possible to shorten the time required for a total image forming job even when the job consists of both monochrome and multi-color images.

According to the color image forming apparatus and its control method of the present invention, the system is controlled in such a manner that the image supports which have remained stationary are actuated to rotate when the image supports are abutted against the transfer support. Accordingly, abrasion between the image supports and the transfer support can be lessened, so that it is possible to prevent development of degradation not only of the image supports but also the transfer support.

According to the color image forming apparatus and its control method of the present invention, the image supports and the transfer support are made to abut each other under the condition where their rotational speeds synchronized. Accordingly, it is possible to substantially avoid rubbing between the image supports and the transfer support, hence it is possible to prevent development of degradation of each part.

According to the color image forming apparatus and its control method of the present invention, either the monochrome image forming mode or the multi-color image forming mode may be set as the initialization mode. Accordingly, the image forming mode which is used more frequently can be set as the initialization. Therefore, it is possible to lessen the number of changes in image forming mode and hence further shorten the time required for image forming.

According to the color image forming apparatus and its control method of the present invention, the initial mode can be set up depending on the user's usage status. Accordingly, it is possible to minimize the number of changes in image forming mode and hence further shorten the time required for image forming.

According to the color image forming apparatus of the present invention, the scheme of the image forming mode change can be realized in both the color image forming apparatus in which the images are directly transferred from the image supports to the recording sheet and the color image forming apparatus in which an intermediate transfer support is provided.

According to the color image forming apparatus of the present invention, abutment and separation between the image supports and the transfer support can be realized by the movement of the image support side, the movement of the transfer support or combined movement of both parts. Accordingly, the part to be moved can be selected taking into account the detailed configuration of the color image forming apparatus.

According to the color image forming apparatus of the present invention, the conveyance of the recording sheet is speeded up until the rear end of the recording sheet passes through the most upstream image forming device used in the multi-color image forming devices. Accordingly, it is possible to prevent the recording sheet from being rubbed by the image forming devices for the multi-color image forming mode and hence avoid printing failure due to rubbing. In contrast, when the speed of conveyance of the recording sheet in the image forming devices used in the multi-color image forming mode is set equal to that in the image forming device used in the monochrome image forming mode, it takes long time to convey the sheet, and the next printing process cannot be started till the transfer support abuts the image forming devices used for the multi-color image forming mode.

According to the color image forming apparatus of the present invention, the speed of the transfer support is increased until the recording sheet passes through at least the most upstream image forming device that is used in the multi-color image forming mode. Accordingly, it is possible to shorten the time to the start of next printing and it is possible to improve print quality because no rubbing with the unfixed toner will occur at each image forming device to which the transfer support abuts, successively.

According to the color image forming apparatus of the present invention, the speed of the transfer support and the speed of each image support are set substantially equal to each other. Accordingly, it is possible to achieve improved print quality because no rubbing of the transfer support with the unfixed toner will occur. On the contrary, if the transfer support alone is speeded up, the transfer support is rubbed by the image supports of the image forming devices as they come into contact with the transfer support, successively. This may cause damage to the image support, deteriorate the photosensitive layers and lower the print quality.

According to the color image forming apparatus of the present invention, the peripheral speed of the image forming devices is specified to fall within the range of 1.0 to 1.2 times of the speed of conveyance of the recording sheet on the transfer support. Accordingly, it is possible to achieve a more improved print quality. On the contrary, if the peripheral speed of the image forming devices is specified to be equal to or greater than 1.2 times of the speed of conveyance of the recording sheet on the transfer support, the speed of the transfer support is, relatively, too low, so the friction between the opposing elements becomes large, possibly causing damage to the image supports, deteriorating the photosensitive layers and degrading print quality.

According to the color image forming apparatus of the present invention, the status in which the rotational speed of the image forming devices, used in the multi-color image forming mode, is greater than the speed of conveyance of the recording sheet on the transfer support is made to end after the rear end of the recording sheet has passed through the most downstream image forming device adjacent to the fixing mechanism to be located next to the transfer support and the rotational speed of the image forming devices is shifted into the speed for the multi-color image forming mode. Accordingly, it is possible to promote the printing stability and speedup of a next printing process.

According to the color image forming apparatus of the present invention, a higher voltage than the erasing voltage applied while transfer support is driven at the normal speed is applied to the transfer support erasing element while the transfer support is driven at the high speed. Accordingly, it is possible to improve print quality and prevent the transfer support from meandering while it is rotating. On the contrary, if the erasing voltage for the period of the normal rotation is applied to the transfer support erasing element, the friction of the transfer support with the drive roller, idle roller and transfer support meandering prevention mechanism and the like increases, the transfer support will be charged much more than the normal state.

According to the color image forming apparatus of the present invention, a higher voltage than the erasing voltage applied while transfer support is driven at the normal speed is applied to the transfer support erasing element during the period in which the rotational speed of the image forming devices is equal to or greater than the speed of conveyance of the recording sheet on the transfer support. Accordingly, it is possible to normalize the surface potential for the next printing process as well as to improve print quality. On the contrary, if the erasing voltage to be applied when the transfer support is driven at the normal speed is applied to the erasing element, frictions between the image support and parts in contact therewith (e.g., developer sleeve, cleaning blade) become greater and hence the residual potential on the image support increases.

According to the color image forming apparatus of the present invention, the speed of conveyance of the recording sheet is increased until the toner which has been transferred to the recording sheet but remains unfixed reaches the fixing mechanism, whereby it is possible to shorten the time before the start of a next printing operation.

According to the color image forming apparatus of the present invention, the speed of conveyance of the recording sheet in the fixing mechanism is set to be constant from when the leading edge of a recording sheet reaches the fixing mechanism until the rear end of the recording sheet passes through the fixing unit. Accordingly, it is possible to prevent a single recording sheet from being processed through the fixing mechanism at varying speeds and hence avoid occurrence of unevenness in print quality within a single sheet.

What is claimed is:

1. A color image forming apparatus, comprising:

a plurality of image forming devices placed serially in the direction of conveyance of recording sheets;

a transfer support which is arranged in abutment with image supports provided in the image forming devices and is separable therefrom, for transferring images from the image supports to a recording sheet;

a mode switching means for making a changeover between a monochrome image forming mode for forming images by abutting the transfer support with only an image support of one image forming device of the plural image forming devices and a multi-color image forming mode for forming images by abutting the transfer support with the image supports of the plural image forming devices; and a control means for governing the image forming devices, the image supports, the transfer support and the mode switching means, the control means making a control so that the transfer support can abut only the image forming devices which are actually engaged in image forming, among the plural image forming devices, wherein when the images are formed in the monochrome image forming mode, the transfer support abuts only the image support of the most upstream image forming device in the direction of the conveyance of the recording sheet, and wherein the mode switching means starts the changeover from the monochrome image forming mode to the multi-color image forming mode while the recording sheet remains on the transfer support.

2. A color image forming apparatus, comprising:

a plurality of image forming devices placed serially in the direction of conveyance of recording sheets;

a transfer support which is arranged in abutment with image supports provided in the image forming devices and is separable therefrom, for transferring images from the image supports to a recording sheet;

a mode switching means for making a changeover between a monochrome image forming mode for forming images by abutting the transfer support with only an image support of one image forming device of the plural image forming devices and a multi-color image forming mode for forming images by abutting the transfer support with the image supports of the plural image forming devices; and a control means for governing the image forming devices, the image supports, the transfer support and the mode switching means, the control means making a control so that the transfer support can abut only the image forming devices which are actually engaged in image forming, among the plural image forming devices, wherein when the images are formed in the monochrome image forming mode, the transfer support abuts only the image support of the most upstream image forming device in the direction of the conveyance of the recording sheet, wherein the mode switching means starts the changeover from the monochrome image forming mode to the multi-color image forming mode while the recording sheet remains on the transfer support, and wherein the transfer support conveys the recording sheet at a speed higher than the speed of conveyance of the recording sheet at the image forming device used in the monochrome image forming mode, during the period from when the rear end of the recording sheet has passed through the image forming device used for the monocrome image forming mode until it passes through at least the most upstream image forming device among those used in the multi-color mode.

3. The color image forming apparatus according to claim 1, wherein each of the image supports is comprised of a rotational photoreceptor drum and the control means makes a control so that the transfer support abuts the image supports after the image supports start rotating.

4. The color image forming apparatus according to claim 2, wherein each of the image supports is comprised of a rotational photoreceptor drum and the control means makes a control so that the transfer support abuts the image supports after the image supports start rotating.

5. The color image forming apparatus according to claim 3, wherein at least the surface of the transfer support moves in the direction of conveyance of the recording sheet and the control means makes a control so that the image supports and transfer support abut each other after the rotational speeds of the image supports and that of the transfer support coincide.

6. The color image forming apparatus according to claim 4, wherein at least the surface of the transfer support moves in the direction of conveyance of the recording sheet and the control means makes a control so that the image supports and transfer support abut each other after the rotational speeds of the image supports and that of the transfer support coincide.

7. The color image forming apparatus according to claim 1 or 2, wherein the initial mode when the power supply is turned on and in the ready mode can be set at either the monochrome image forming mode or the multi-color image forming mode.

8. The color image forming apparatus according to claim 7, further comprising a control means for setting the initial mode at the activation of the power supply and at the ready mode, into either the monochrome image forming mode or the multi-color image forming mode.

9. The color image forming apparatus according to claim 1 or 2, wherein the transfer support is comprised of a transfer and conveyance support for conveying the recording sheet by its rotationally moving surface or an intermediate transfer support to which images are transferred from the image supports.

10. The color image forming apparatus according to claim 1 or 2, further comprising a shifting means for shifting the image supports and/or the transfer support.

11. The color image forming apparatus according to claim 1 or 2, wherein, upon a mode change from the monochrome image forming mode to the multi-color image forming mode, the transfer support is caused to abut the plural image forming devices used for the multi-color image forming mode, after when the rear end of the recording sheet having passed through the transfer station of the image forming device used for the monochrome image forming mode, has passed through the most upstream image forming device of those used in the multi-color image forming mode.

12. The color image forming apparatus according to claim 1 or 2, wherein printing at a mode change from the monochrome image forming mode to the multi-color image forming mode starts after at least one of the image forming devices used for the multi-color image forming mode has become abutted with the transfer support.

13. A color image forming apparatus comprising:

a plurality of image forming devices placed serially in the direction of conveyance of recording sheets;

a transfer support which is arranged in abutment with image supports provided in the image forming devices and is separable therefrom, for transferring images from the image supports to a recording sheet;

a mode switching means for making a changeover between a monochrome image forming mode for forming images using only one image forming device of the plural image forming devices and a multi-color image forming mode for forming images using the plural image forming devices; and a control means for governing the image forming devices, the image supports, the transfer support and the mode switching means, the control means making a control so that the transfer support can abut only the image forming devices which are actually engaged in image forming, among the plural image forming devices, wherein the mode switching means starts the changeover from the monochrome image forming mode to the multi-color image forming mode while the recording sheet remains on the transfer support, wherein the mode switching means starts the mode change immediately after the image has been transferred from the image support of the most upstream image forming device to the recording sheet, and wherein, upon a mode change from the monochrome image forming mode to the multi-color image forming mode, the speed of conveyance of the recording sheet on the transfer support is increased to be greater than the speed of conveyance of the recording sheet passing at the image forming device used in the monochrome image forming mode, and during this period, the image forming devices for the monochrome image forming mode and the multi-color image forming mode, abutting the transfer support, are rotated at a peripheral speed equal to or greater than the speed at which the recording sheet is conveyed by the transfer support.

14. The color image forming apparatus according to claim 13, wherein the peripheral speeds of the image forming devices used in the monochrome image forming mode and in the multi-color image forming mode are set to fall within the range of 1.0 to 1.2 times of the speed at which the recording sheet is conveyed by the transfer support.

15. The color image forming apparatus according to claim 13, wherein the status in which the rotational speed of the image forming devices used in the multi-color image forming mode is greater than the speed of conveyance of the recording sheet on the transfer support is made to end after the rear end of the recording sheet has passed through the most downstream image forming device adjacent to the fixing mechanism to be located next to the transfer support and the rotational speed of the image forming devices is shifted into the speed for the multi-color image forming mode.

16. The color image forming apparatus according to claim 2, wherein the speed of conveyance of the recording sheet by the transfer support is increased to be greater than the speed of conveyance of the recording sheet passing at the image forming device used in the monochrome image forming mode, and during this period, a higher voltage than the erasing voltage that is applied at the normal speed is applied to a transfer support erasing element arranged with the transfer support.

17. The color image forming apparatus according to claim 13, wherein a higher voltage than the erasing voltage that is applied at the normal speed is applied to the erasing elements of the image forming devices used in the monochrome image forming mode and the multi-color image forming mode, during the period in which the rotational speed of the image forming devices used in the monochrome image forming mode and the multi-color image forming mode is set to be equal to or greater than the speed of conveyance of the recording sheet on the transfer support.

18. A color image forming apparatus, comprising:

a plurality of image forming devices placed serially in the direction of conveyance of recording sheets;

a transfer support which is arranged in abutment with image supports provided in the image forming devices and is separable therefrom, for transferring images from the image supports to a recording sheet;

a mode switching means for making a changeover between a monochrome image forming mode for forming images using only one image forming device of the plural image forming devices and a multi-color image forming mode for forming images using the plural image forming devices; and a control means for governing the image forming devices, the image supports, the transfer support and the mode switching means, the control means making a control so that the transfer support can abut only the image forming devices which are actually engaged in the image forming, among the plural image forming devices, wherein the mode switching means starts the changeover from the monochrome image forming mode to the mult-color image forming mode while the recording sheet remains on the transfer support, wherein the mode switching means starts the mode change immediately after the image has been transferred from the image support of the most upstream image forming device to the recording sheet, and wherein the rotational speed of the plural image forming devices is kept to be equal to or greater than the speed of conveyance of the recording sheet on the transfer support until the leading end of the recording sheet is conveyed to the fixing mechanism which is located downstream of the transfer support.

19. The color image forming apparatus according to claim 18, wherein, upon a mode change from the monochrome image forming mode to the multi-color image forming mode, the speed at which the recording sheet is conveyed through the fixing mechanism is kept constant from the leading end of the recording sheet reaches the fixing mechanism until the rear end of the recording sheet passes through the fixing mechanism.

20. A control method of a color image forming apparatus which comprises: a plurality of image forming devices placed serially in the direction of conveyance of recording sheets; and a transfer support arranged in abutment with each image support provided in each image forming device, in a separable manner therefrom, and is controlled so that the transfer support is separated from the image supports when a plurality of image forming devices are not used for image forming, wherein an operating mode can be changed over between a monochrome image forming mode for forming images using only one image forming device of the plural image forming devices and a multi-color image forming mode for forming images using the plurality of image forming devices, wherein the mode change from the monochrome image forming mode to the multi-color image forming mode is started while the recording sheet remains on the transfer support, wherein the mode switching means starts the mode change immediately after the image has been transferred from the image support of the most upstream image forming device to the recording sheet, and wherein the transfer support conveys the recording sheet at a speed higher than the speed of conveyance of the recording sheet at the image forming device used in the monochrome image forming mode, during the period from when the rear end of the recording sheet has passed through the image forming device used for the monochrome image forming mode until it passes through at least the most upstream image forming device among those used in the multi-color mode.

21. The control method of a color image forming apparatus according to claim 20, wherein the action of the image forming mode change is started immediately after the image formed on the image support of the most upstream image forming device has transferred to the recording sheet.

22. The control method of a color image forming apparatus according to claim 20, wherein the image supports and the transfer support are both configured to be rotatable and the transfer support is caused to abut the image supports after the image supports have started rotating.

23. The control method of a color image forming apparatus according to claim 21, wherein the image supports and the transfer support are both configured to be rotatable and the transfer support is caused to abut the image supports after the image supports have started rotating.

24. The control method of a color image forming apparatus according to claim 22, wherein the image supports and the transfer support are made to abut each other after the rotational speeds of the image supports and that of the transfer support at the abutment portions coincide.

25. The control method of a color image forming apparatus according to claim 23, wherein the image supports and the transfer support are made to abut each other after the rotational speeds of the image supports and that of the transfer support at the abutment portions coincide.

26. The control method of a color image forming apparatus according to claim 20, wherein the initial mode when the power supply is turned on and in the ready mode can be set at either the monochrome image forming mode or the multi-color image forming mode.

27. The control method of a color image forming apparatus according to claim 21, wherein the initial mode when the power supply is turned on and in the ready mode can be set at either the monochrome image forming mode or the multi-color image forming mode.

28. The control method of a color image forming apparatus according to claim 22, wherein the initial mode when the power supply is turned on and in the ready mode can be set at either the monochrome image forming mode or the multi-color image forming mode.

29. The control method of a color image forming apparatus according to claim 23, wherein the initial mode when the power supply is turned on and in the ready mode can be set at either the monochrome image forming mode or the multi-color image forming mode.

30. The control method of a color image forming apparatus according to claim 24, wherein the initial mode when the power supply is turned on and in the ready mode can be set at either the monochrome image forming mode or the multi-color image forming mode.

31. The control method of a color image forming apparatus according to claim 25, wherein the initial mode when the power supply is turned on and in the ready mode can be set at either the monochrome image forming mode or the multi-color image forming mode.

32. The control method of a color image forming apparatus according to claim 26, wherein the initial mode is set to be either the monochrome image forming mode or the multi-color image forming mode by the predetermined operation through a control means.

33. The control method of a color image forming apparatus according to claim 27, wherein the initial mode is set to be either the monochrome image forming mode or the multi-color image forming mode by the predetermined operation through a control means.

34. The control method of a color image forming apparatus according to claim 28, wherein the initial mode is set to be either the monochrome image forming mode or the multi-color image forming mode by the predetermined operation through a control means.

35. The control method of a color image forming apparatus according to claim 29, wherein the initial mode is set to be either the monochrome image forming mode or the multi-color image forming mode by the predetermined operation through a control means.

36. The control method of a color image forming apparatus according to claim 31, wherein the initial mode is set to be either the monochrome image forming mode or the multi-color image forming mode by the predetermined operation through a control means.

37. The control method of a color image forming apparatus according to claim 31, wherein the initial mode is set to be either the monochrome image forming mode or the multi-color image forming mode by the predetermined operation through a control means.

* * * * *